US010656542B2

(12) United States Patent
Nishi et al.

(10) Patent No.: US 10,656,542 B2
(45) Date of Patent: May 19, 2020

(54) ELECTROPHOTOGRAPHIC PHOTOSENSITIVE MEMBER, PROCESS CARTRIDGE, ELECTROPHOTOGRAPHIC APPARATUS, AND METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Masashi Nishi, Susono (JP); Kunihiko Sekido, Suntou-gun (JP); Yuka Ishiduka, Suntou-gun (JP); Akihiro Maruyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/377,027

(22) Filed: Apr. 5, 2019

(65) Prior Publication Data

US 2019/0310561 A1 Oct. 10, 2019

(30) Foreign Application Priority Data

Apr. 10, 2018 (JP) ..... 2018-075769

(51) Int. Cl.

| | |
|---|---|
| ***G03G 5/00*** | (2006.01) |
| ***G03G 5/043*** | (2006.01) |
| ***G03G 5/082*** | (2006.01) |
| ***G03G 5/07*** | (2006.01) |
| ***G03G 5/14*** | (2006.01) |

(52) U.S. Cl.

CPC ..... *G03G 5/0436* (2013.01); *G03G 5/078* (2013.01); *G03G 5/08214* (2013.01); *G03G 5/14* (2013.01)

(58) Field of Classification Search

CPC ..... G03G 5/14
USPC ..... 430/60
See application file for complete search history.

(56) References Cited

U.S. PATENT DOCUMENTS

| | | | | |
|---|---|---|---|---|
| 9,726,992 | B2 * | 8/2017 | Sakuma | G03G 5/0436 |
| 2004/0183883 | A1 * | 9/2004 | Suzuki | G03G 5/0578 347/118 |

FOREIGN PATENT DOCUMENTS

| | | | |
|---|---|---|---|
| JP | 3717320 | B2 | 11/2005 |
| JP | 2015-143828 | A | 8/2015 |
| JP | 2016-138931 | A | 8/2016 |

OTHER PUBLICATIONS

Shinzo Yamashita et al, Amino Resin-Crosslinking agent of Alkyd Resin, Kakyozai Handbook (Handbook of crosslinking agents), 1981, p. 536-543; 594-605, Taiseisha Ltd.

* cited by examiner

*Primary Examiner* — Mark A Chapman
(74) *Attorney, Agent, or Firm* — Canon U.S.A.Inc., IP Division

(57) ABSTRACT

An electrophotographic photosensitive member includes an undercoat layer, a charge generation layer, and a charge transport layer in this order. The undercoat layer contains a cured product of a composition containing an electron transport material, a particle having an average primary particle size of 10 nm or more, and a silicone oil. A content of the particle in the undercoat layer is 3% by mass or more and 20% by mass or less. A content of the silicone oil in the undercoat layer is 0.01% by mass or more and 10% by mass or less relative to the content of the particle.

9 Claims, 2 Drawing Sheets

ELECTROPHOTOGRAPHIC PHOTOSENSITIVE MEMBER, PROCESS CARTRIDGE, ELECTROPHOTOGRAPHIC APPARATUS, AND METHOD FOR PRODUCING ELECTROPHOTOGRAPHIC PHOTOSENSITIVE MEMBER

BACKGROUND OF THE INVENTION

Field of the Invention

The present disclosure relates to an electrophotographic photosensitive member and a method for producing the same and a process cartridge and an electrophotographic apparatus that include the electrophotographic photosensitive member.

Description of the Related Art

Currently, the mainstream electrophotographic photosensitive members mounted on process cartridges and electrophotographic apparatuses are those containing organic photoconductive substances (organic electrophotographic photosensitive members, hereinafter also referred to as "photosensitive members"). Electrophotographic photosensitive members that use organic photoconductive substances have advantages such as nonpolluting characteristics, high productivity, and the ease of material design.

An electrophotographic photosensitive member typically includes a support and a photosensitive layer formed on the support. The photosensitive layer is typically a multilayer photosensitive layer in which a charge generation layer and a charge transport layer are stacked in that order from the support side. Furthermore, an intermediate layer is often disposed between the support and the photosensitive layer to suppress charge injection from the support side to the photosensitive layer side and to suppress occurrence of image failure such as black spots. An undercoat layer such as a conductive layer may be disposed between the support and the intermediate layer.

In recent years, charge generation materials having higher sensitivity have been used. However, with the increase in sensitivity of the charge generation materials, the amount of charges generated increases, resulting in a disadvantage in that charges tend to remain in the charge generation layer.

A technique for achieving smooth migration of electrons from the charge generation layer side to the support side by incorporating an electron transport material in an undercoat layer is known as a technique for suppressing the remaining of charges in the charge generation layer. In another known technique, in the case where an electron transport material is incorporated in an undercoat layer, a curable material that is hardly soluble in a solvent of a coating liquid for a charge generation layer is used in the undercoat layer in order to prevent elution of the electron transport material during the formation of the charge generation layer on the undercoat layer.

A technique in which particles are incorporated in order to further improve characteristics of an undercoat layer formed by using such a curable material is also known.

Japanese Patent Laid-Open No. 2016-138931 discloses a technique in which silica particles are incorporated in an undercoat layer formed by using a curable material. Japanese Patent Laid-Open No. 2015-143828 discloses a technique in which resin particles are incorporated in an undercoat layer formed by using a curable material.

SUMMARY OF THE INVENTION

The present disclosure provides an electrophotographic photosensitive member including an undercoat layer, a charge generation layer, and a charge transport layer in this order. The undercoat layer contains a cured product of a composition containing an electron transport material, a particle having an average primary particle size of 10 nm or more, and a silicone oil. A content of the particle in the undercoat layer is 3% by mass or more and 20% by mass or less. A content of the silicone oil in the undercoat layer is 0.01% by mass or more and 10% by mass or less relative to the content of the particle.

The present disclosure further relates to a process cartridge detachably attachable to a main body of an electrophotographic apparatus, the process cartridge integrally supporting the above electrophotographic photosensitive member and at least one device selected from the group consisting of a charging device, a developing device, a transfer device, and a cleaning device.

The present disclosure further relates to an electrophotographic apparatus including the above electrophotographic photosensitive member, a charging device, an exposure device, a developing device, and a transfer device.

The present disclosure further relates to a method for producing an electrophotographic photosensitive member that includes an undercoat layer, a charge generation layer, and a charge transport layer in this order. The method includes a step of forming an undercoat layer by drying a coating film of a coating liquid for an undercoat layer by heating, the coating liquid containing an electron transport material, a particle having an average primary particle size of 10 nm or more, a silicone oil, a compound represented by formula (A), and a compound represented by formula (B). In the method, a ratio of the particle to a total solid content in the coating liquid for an undercoat layer is 3% by mass or more and 20% by mass or less, a content of the silicone oil in the coating liquid for an undercoat layer is 0.01% by mass or more and 10% by mass or less relative to a content of the particle, and a content of the compound represented by formula (A) in the coating liquid for an undercoat layer is 0.3 times or more and 3.0 times or less a content of the compound represented by formula (B) in terms of mass ratio.

(A)

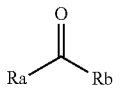

In formula (A), $R_a$ and $R_b$ each independently represent a substituted or unsubstituted alkyl group having 3 or less carbon atoms, and the substituent of the substituted alkyl group is a methyl group.

(B)

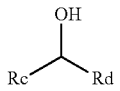

In formula (B), $R_c$ and $R_d$ each independently represent a hydrogen atom or a substituted or unsubstituted alkyl group having 4 or less carbon atoms, and the substituent of the substituted alkyl group is a methyl group.

Further features of the present disclosure will become apparent from the following description of exemplary embodiments with reference to the attached drawings.

DESCRIPTION OF THE EMBODIMENTS

Figure 1:
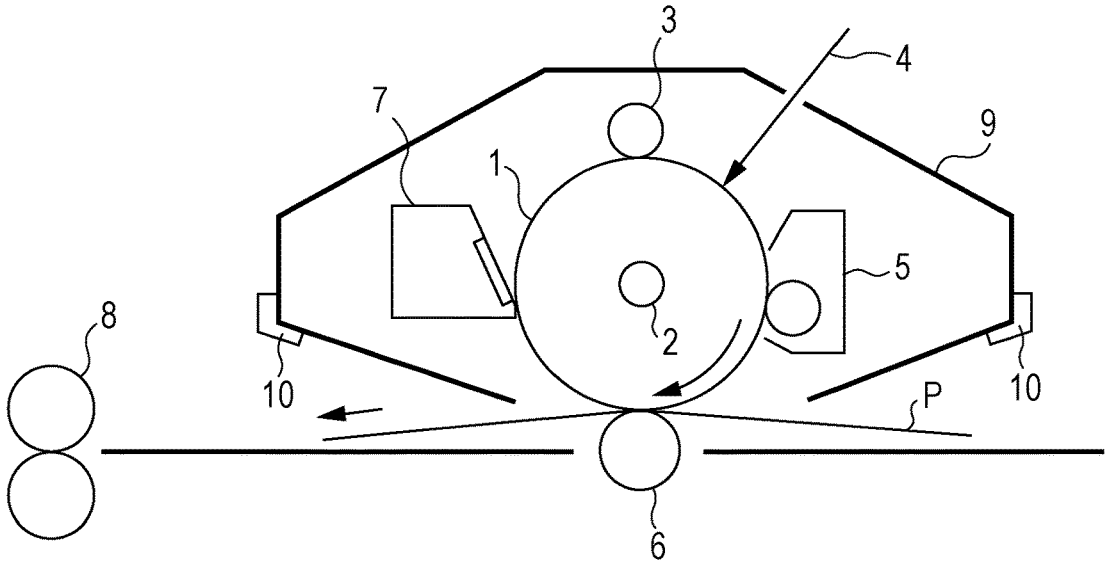
FIG. 1 is a schematic view illustrating a structure of an example of an electrophotographic apparatus including a process cartridge provided with an electrophotographic photosensitive member.

In recent years, requirements for an increase in the speed of image output and quality of images have been increasing, and an acceptable range for the ghost phenomenon, which occurs due to remaining of charges, has become more severe. In addition, with the increase in the speed, an enhancement of the sensitivity of photosensitive members has also been desired more than ever. Degradation of response characteristics due to insufficient sensitivity also contributes to image defects such as the ghost phenomenon. According to the results of studies conducted by the inventors of the present disclosure, there is still room for improvement in the ghost phenomenon and the sensitivity in terms of the techniques disclosed in Japanese Patent Laid-Open Nos. 2016-138931 and 2015-143828.

The present disclosure provides an electrophotographic photosensitive member in which the ghost phenomenon is reduced, a method for producing the electrophotographic photosensitive member, and a process cartridge and an electrophotographic apparatus that include the electrophotographic photosensitive member.

An electrophotographic photosensitive member according to an embodiment of the present disclosure includes an undercoat layer, a charge generation layer, and a charge transport layer in this order. The undercoat layer contains a cured product of a composition containing an electron transport material, a particle having an average primary particle size of 10 nm or more, and a silicone oil. A content of the particle in the undercoat layer is 3% by mass or more and 20% by mass or less. A content of the silicone oil in the undercoat layer is 0.01% by mass or more and 10% by mass or less relative to the content of the particle. The inventors of the present disclosure consider the reason why this configuration reduces ghosts in long-term durability as follows.

Presumably, in the case where particles are further added to an undercoat layer containing a cured product of a composition that contains an electron transport material, cyclic strength is decreased by an increase in internal stress due to curing and unevenness in the layer due to the additional particles. It is considered that defects are consequently generated in the undercoat layer by long-term durable use, and retention of charges tends to occur.

Presumably, when particles and a silicone oil are used in combination as in the present disclosure, the silicone oil, which is usually unevenly present at an interface of stacked films, is unevenly present between the particles in the bulk and other components of the undercoat layer and effectively relieves internal stress in the undercoat layer.

In the case where a silicone oil is unevenly present at an interface of stacked films, the silicone oil inhibits transfer of electrons, and degradation of the sensitivity may occur. However, this degradation can also be suppressed by using the silicone oil in combination with particles. Thus, both the reduction in ghosts and the suppression of degradation of the sensitivity can be realized.

Undercoat Layer

The thickness of the undercoat layer is preferably 0.3 μm or more and 10 μm or less and more preferably 0.4 μm or more and 3.0 μm or less. Still more preferably, the thickness of the undercoat layer is 0.5 μm or more and 1.5 μm or less.

(1) Electron Transport Material

The electron transport material contained in the undercoat layer has an electron-transporting capability and has at least one group selected from the group consisting of a hydroxy group, a thiol group, an amino group, and a carboxyl group. Examples of the electron transport material include ketone compounds, quinone compounds, imide compounds, and cyclopentadienylidene compounds. Specific examples thereof include compounds represented by any of formulae (A1) to (A11) below.

(A1)

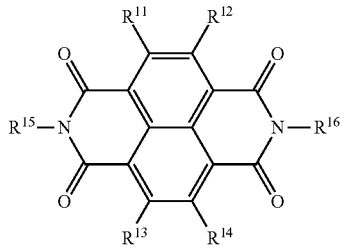

(A2)

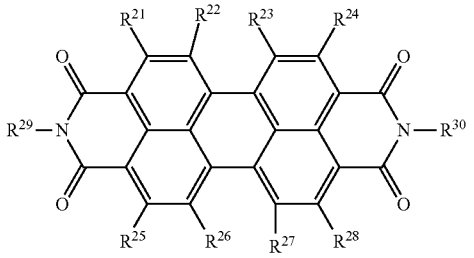

(A3)

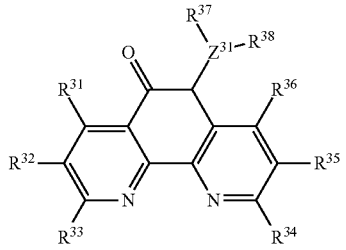

-continued (A4)

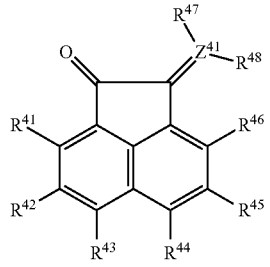

(A5)

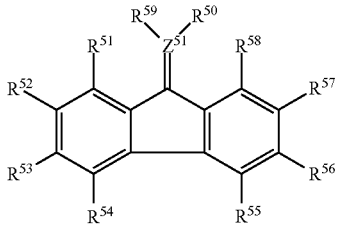

(A6)

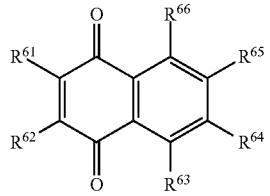

(A7)

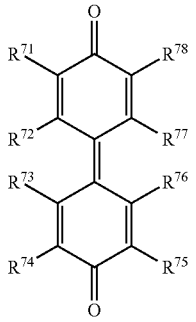

(A8)

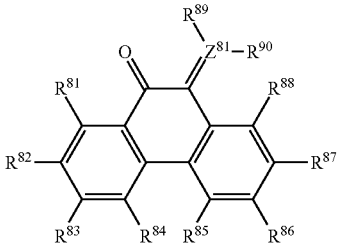

(A9)

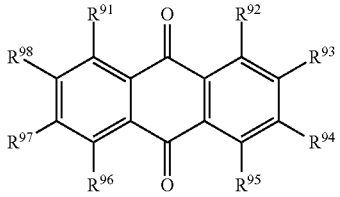

-continued (A10)

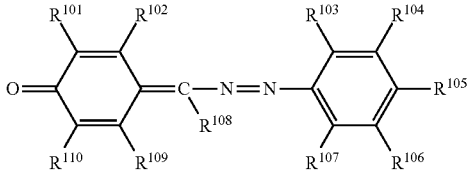

(A11)

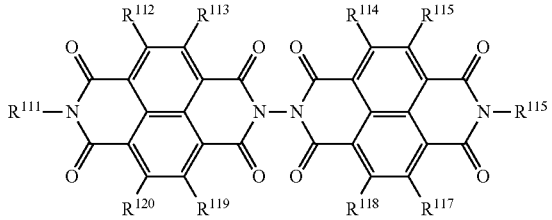

In formulae (A1) to (A11), $R^{11}$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$, and $R^{111}$ to $R^{120}$ each independently represent a monovalent group represented by formula (I) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. One of carbon atoms in the main chain of the alkyl group may be substituted with O, S, NH, or $NR^{121}$ (where $R^{121}$ is an alkyl group). At least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ have the monovalent group represented by formula (I).

The substituent of the substituted alkyl group is an alkyl group, an aryl group, a halogen atom, or an alkoxycarbonyl group. The substituent of the substituted aryl group and the substituent of the substituted heterocyclic group are each a halogen atom, a nitro group, a cyano group, an alkyl group, a halogenated alkyl group, or an alkoxy group. $Z^{31}$, $Z^{41}$, $Z^{51}$, and $Z^{81}$ each independently represent a carbon atom, a nitrogen atom, or an oxygen atom. When $Z^{3'}$ is an oxygen atom, $R^{37}$ and $R^{38}$ are not present. When $Z^{31}$ is a nitrogen atom, $R^{38}$ is not present. When $Z^{41}$ is an oxygen atom, $R^{47}$ and $R^{48}$ are not present. When $Z^{41}$ is a nitrogen atom, $R^{48}$ is not present. When $Z^{51}$ is an oxygen atom, $R^{59}$ and $R^{60}$ are not present. When $Z^{51}$ is a nitrogen atom, $R^{60}$ is not present. When $Z^{81}$ is an oxygen atom, $R^{89}$ and $R^{90}$ are not present. When $Z^{81}$ is a nitrogen atom, $R^{90}$ is not present.

(I)

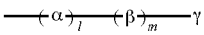

In formula (I), at least one of α, β, and γ is a group having a polymerizable functional group, and the polymerizable functional group is at least one group selected from the group consisting of a hydroxy group, a thiol group, an amino group, and a carboxyl group. In formula (I), l and m are each independently 0 or 1, and the sum of l and m is 0 or more and 2 or less.

α represents an alkylene group having 1 to 6 main-chain carbon atoms, an alkylene group having 1 to 6 main-chain carbon atoms and substituted with an alkyl group having 1 to 6 carbon atoms, an alkylene group having 1 to 6 main-chain carbon atoms and substituted with a benzyl group, an alkylene group having 1 to 6 main-chain carbon atoms and substituted with an alkoxycarbonyl group, or an alkylene group having 1 to 6 main-chain carbon atoms and substituted with a phenyl group. These groups each may have a polymerizable functional group. One of carbon atoms in the main chain of the alkylene group may be substituted with O, S, or $NR^{122}$ (where $R^{122}$ represents a hydrogen atom or an alkyl group).

β represents a phenylene group, a phenylene group substituted with an alkyl having 1 to 6 carbon atoms, a phenylene group substituted with a nitro group, a phenylene group substituted with a halogen group, or a phenylene group substituted with an alkoxy group. These groups each may have a polymerizable functional group.

γ represents a hydrogen atom, an alkyl group having 1 to 6 main-chain carbon atoms, or an alkyl group having 1 to 6 main-chain carbon atoms and substituted with an alkyl group having 1 to 6 carbon atoms. These groups each may have a polymerizable functional group. One of carbon atoms in the main chain of the alkyl group may be substituted with O, S, or $NR^{123}$ (where $R^{123}$ represents a hydrogen atom or an alkyl group).

Derivatives (derivatives of the electron transport material) having any of the structures of formulae (A3) to (A6), (A8), and (A9) are available from Tokyo Chemical Industry Co., Ltd., Sigma-Aldrich Japan K.K., and Johnson Matthey Japan G.K. The derivative having the structure of formula (A1) can be synthesized by a reaction between naphthalenetetracarboxylic dianhydride available from Tokyo Chemical Industry Co., Ltd. or Johnson Matthey Japan G.K. and a monoamine derivative. The derivative having the structure of formula (A2) can be synthesized by a reaction between perylenetetracarboxylic dianhydride available from Tokyo Chemical Industry Co., Ltd. or Sigma-Aldrich Japan K.K. and a monoamine derivative. The derivative having the structure of formula (A7) can be synthesized by using, as a raw material, a phenol derivative available from Tokyo Chemical Industry Co., Ltd. or Sigma-Aldrich Japan K.K. The derivative having the structure of formula (A10) can be synthesized by oxidizing a phenol derivative having a hydrazone structure in an organic solvent with an appropriate oxidizing agent such as potassium permanganate using, for example, the known synthesis method described in Japanese Patent Publication No. 3717320. The derivative having the structure of formula (A11) can be synthesized by a reaction of naphthalenetetracarboxylic dianhydride available from Tokyo Chemical Industry Co., Ltd., Sigma-Aldrich Japan K.K., or Johnson Matthey Japan G.K., a monoamine derivative, and hydrazine.

A compound represented by any of formulae (A1) to (A11) has a polymerizable functional group (a hydroxy group, a thiol group, an amino group, or a carboxyl group) polymerizable with a crosslinking agent. Examples of the method for synthesizing a compound represented by any of formulae (A1) to (A11) by introducing a polymerizable functional group into a derivative having any of the structures of formulae (A1) to (A11) are as follows.

Examples of the method include a method in which a derivative having any of the structures of formulae (A1) to (A11) is synthesized, and a polymerizable functional group is then directly introduced into the derivative, and a method in which a structure having a polymerizable functional group or a functional group that can serve as a precursor of the polymerizable functional group is introduced into the derivative. Examples of the latter method include a method for introducing an aryl group having a functional group by, for example, conducting a cross-coupling reaction on a halide of a derivative having any of the structures of formulae (A1) to (A11) using a palladium catalyst and a base, a method for introducing an alkyl group having a functional group by conducting a cross-coupling reaction on a halide of a derivative having any of the structures of formulae (A1) to (A11) using an $FeCl_3$ catalyst and a base, and a method for introducing a hydroxyalkyl group or a carboxyl group by allowing an epoxy compound or $CO_2$ to act on a lithiated halide of a derivative having any of the structures of formulae (A1) to (A11).

The electron transport material may be at least one selected from compounds represented by formulae (A1) and (A2).

(A1)

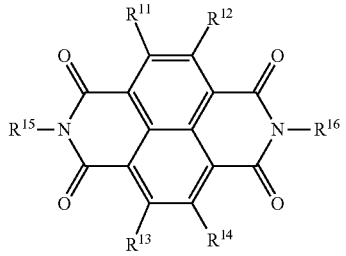

In formula (A1), $R^{15}$ and $R^{16}$ are each independently a substituted or unsubstituted alkyl group having 2 to 6 carbon atoms, a group obtained by substituting at least one $CH_2$ in the main chain of a substituted or unsubstituted alkyl group having 3 to 6 main-chain carbon atoms with an oxygen atom, a group obtained by substituting at least one $CH_2$ in the main chain of a substituted or unsubstituted alkyl group having 3 to 6 main-chain carbon atoms with $NR^{24}$, a group obtained by substituting at least one $C_2H_4$ in the main chain of a substituted or unsubstituted alkyl group having 3 to 6 main-chain carbon atoms with COO, or a substituted aryl group. $R^{124}$ represents a hydrogen atom or an alkyl group having 1 to 4 carbon atoms. The substituents of the substituted alkyl group, the group obtained by substituting at least one $CH_2$ in the main chain of the substituted alkyl group with an oxygen atom, the group obtained by substituting at least one $CH_2$ in the main chain of the substituted alkyl group with $NR^{124}$, and the group obtained by substituting at least one $C_2H_4$ in the main chain of the substituted alkyl group with COO are each a group selected from the group consisting of an alkyl group having 1 to 5 carbon atoms, a benzyl group, an alkoxycarbonyl group, a phenyl group, a hydroxy group, a thiol group, an amino group, and a carboxyl group. The substituent of the substituted aryl group is a group selected from the group consisting of a halogen atom, a cyano group, a nitro group, a methyl group, an ethyl group, an isopropyl group, a n-propyl group, a n-butyl group, an acyl group, an alkoxy group, an alkoxycarbonyl group, a hydroxy group, a thiol group, an amino group, and a carboxyl group.

At least one of $R^{15}$ and $R^{16}$ has at least one hydroxy group or at least one carboxyl group as a substituent. Furthermore, at least one of $R^{15}$ and $R^{16}$ preferably has at least two hydroxy groups or at least two carboxyl groups as substituents.

$R^{11}$ to $R^{14}$ each independently represent a hydrogen atom, a halogen atom, a cyano group, a nitro group, a substituted or unsubstituted alkyl group having 1 to 6 carbon atoms, or a substituted or unsubstituted aryl group.

(A2)

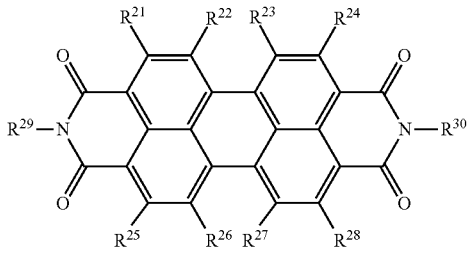

In formula (A2), $R^{29}$ and $R^{30}$ are each independently a substituted or unsubstituted alkyl group having 2 to 6 carbon atoms, a group obtained by substituting at least one $CH_2$ in the main chain of a substituted or unsubstituted alkyl group having 3 to 6 main-chain carbon atoms with an oxygen atom, a group obtained by substituting at least one $CH_2$ in the main chain of a substituted or unsubstituted alkyl group having 3 to 6 main-chain carbon atoms with $NR^{124}$, a group obtained by substituting at least one $C_2H_4$ in the main chain of a substituted or unsubstituted alkyl group having 3 to 6 main-chain carbon atoms with COO, or a substituted aryl group. $R^{124}$ represents a hydrogen atom or an alkyl group having 1 to 4 carbon atoms. The substituents of the substituted alkyl group, the group obtained by substituting at least one $CH_2$ in the main chain of the substituted alkyl group with an oxygen atom, the group obtained by substituting at least one $CH_2$ in the main chain of the substituted alkyl group with $NR^{24}$, and the group obtained by substituting at least one $C_2H_4$ in the main chain of the substituted alkyl group with COO are each a group selected from the group consisting of an alkyl group having 1 to 5 carbon atoms, a benzyl group, an alkoxycarbonyl group, a phenyl group, a hydroxy group, a thiol group, an amino group, and a carboxyl group. The substituent of the substituted aryl group is a group selected from the group consisting of a halogen atom, a cyano group, a nitro group, a methyl group, an ethyl group, an isopropyl group, a n-propyl group, a n-butyl group, an acyl group, an alkoxy group, an alkoxycarbonyl group, a hydroxy group, a thiol group, an amino group, and a carboxyl group.

At least one of $R^{29}$ and $R^{30}$ has at least one hydroxy group or at least one carboxyl group as a substituent.

$R^{21}$ to $R^{28}$ each independently represent a hydrogen atom, a halogen atom, a cyano group, a nitro group, a substituted or unsubstituted alkyl group having 1 to 6 carbon atoms, or a substituted or unsubstituted aryl group.

Specific examples of the electron transport material are shown in Table 1 below, but the present disclosure is not limited to these examples. In the present disclosure, the electron transport materials may be used alone or in combination of two or more thereof.

TABLE 1

| Exemplary compound | Structure |
|---|---|
| A1-1 | 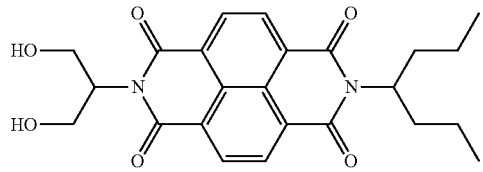 |
| A1-2 | 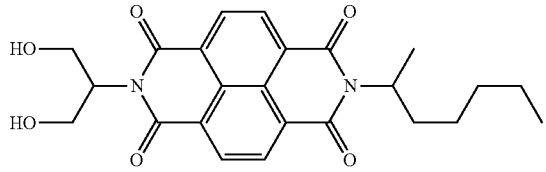 |
| A1-3 | 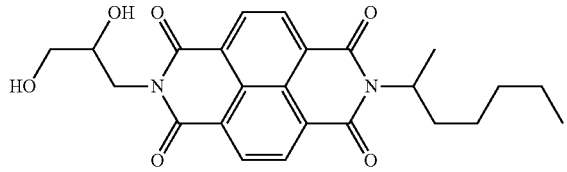 |
| A1-4 | 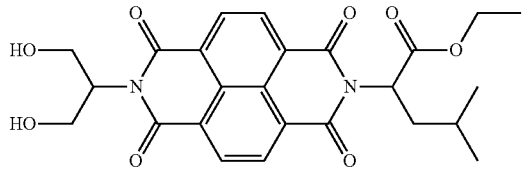 |

TABLE 1-continued
| Exemplary compound | Structure |
|---|---|
| A1-5 | 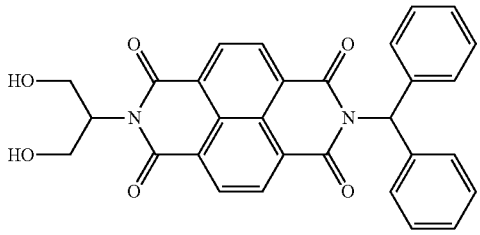 |
| A1-6 | 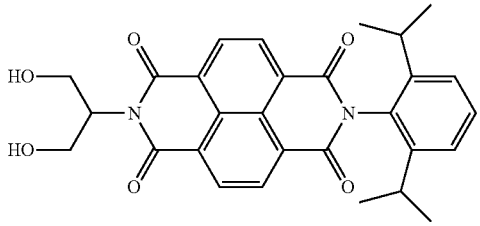 |
| A1-7 | 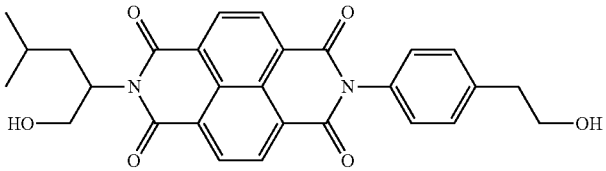 |
| A1-8 | 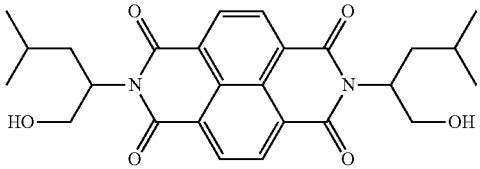 |
| A1-9 | 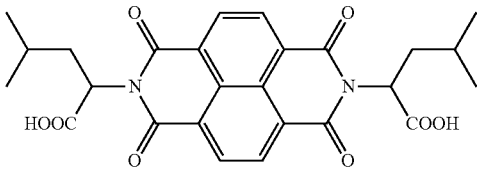 |
| A1-10 | 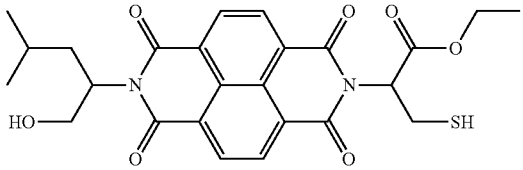 |
| A2-1 | 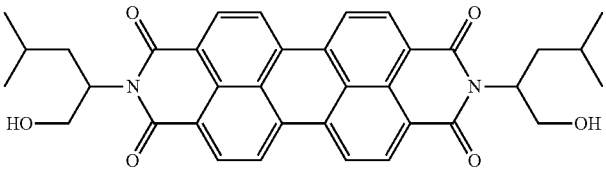 |
| A2-2 | 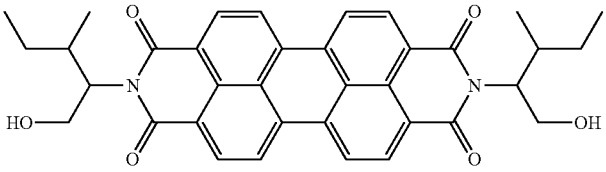 |

TABLE 1-continued
| Exemplary compound | Structure |
|---|---|
| A2-3 | 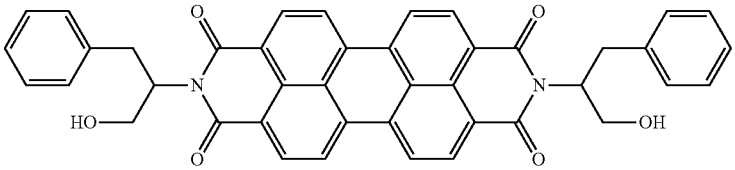 |
| A2-4 | 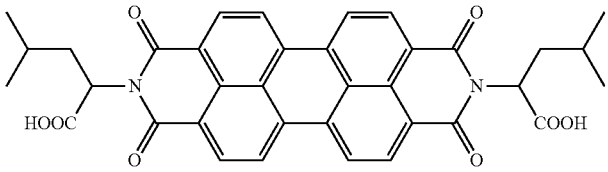 |
| A2-5 | 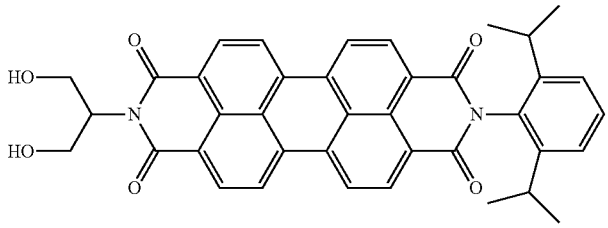 |
| A2-6 | 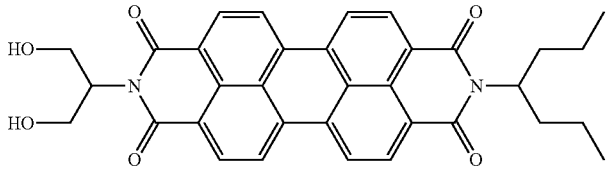 |
| A2-7 | 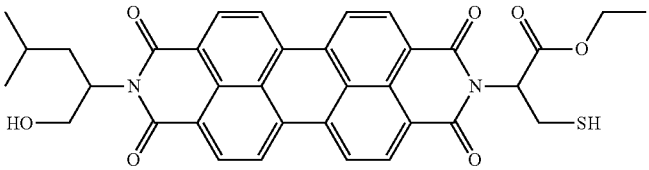 |
| A2-8 | 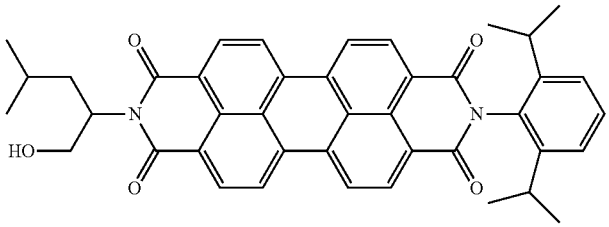 |
| A2-9 | 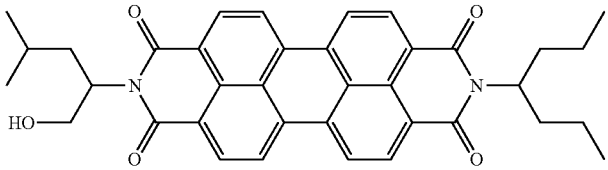 |
| A2-10 | 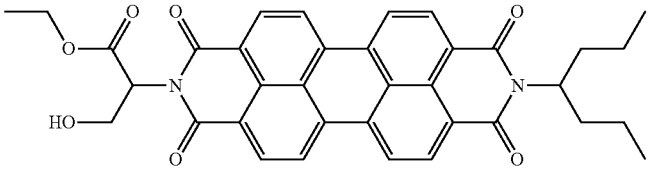 |

(2) Particle

Examples of the particles include inorganic particles and organic resin particles. Examples of the inorganic particles include metal oxides, inorganic salts such as inorganic chlorides and inorganic bromides, inorganic oxides, and ceramics such as clay and silicon nitride. These may be used alone or in combination of two or more thereof. Of these, inorganic oxides are preferred from the viewpoint of chemical stability, silica, alumina, titanium oxide, and zinc oxide are more referred, and silica particles are particularly preferred.

Surfaces of inorganic particles may be subjected to a hydrophobic treatment. Examples of a surface treatment agent include silane coupling agents. Specific examples of the silane coupling agents include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane.

Examples of the organic resin particles include resin particles such as particles of curable rubbers, polystyrene, polyurethanes, polymethyl methacrylate, epoxy resins, alkyd resins, phenolic resins, polyesters, silicone resins, acrylic-melamine resins, and fluorine atom-containing resins. When particles are mixed in a coating liquid for an undercoat layer, powder-like particles may be mixed or a slurry containing particles dispersed in a solvent may be mixed. Powder-like particles can be dispersed with an emulsifying or dispersing apparatus, such as a homogenizer, a line mixer, an ultra-disperser, a homo mixer, a liquid-collision-type high-speed dispersing apparatus, or an ultrasonic dispersing apparatus, or a mixing apparatus such as a mixer.

The content of the particles in the undercoat layer is 3% by mass or more and 20% by mass or less relative to the total mass of the particles and a binder resin in the undercoat layer after curing. The content of the particles in the undercoat layer is more preferably 4% by mass or more and 10% by mass or less. Ghosts can be more effectively suppressed within this range.

The average primary particle size of the particles is 10 nm or more and preferably 500 nm or less. Silica particles having an average primary particle size of 10 nm or more and 500 nm or less are particularly preferred.

(3) Silicone Oil

Examples of the silicone oil include straight silicone oils and modified silicone oils. Examples of the straight silicone oils include dimethyl silicone oil, methyl phenyl silicone oil, and methyl hydrogen silicone oil. Examples of the modified silicone oils include reactive silicone oils such as amino-modified, epoxy-modified, carboxyl-modified, carbinol-modified, methacrylic-modified, mercapto-modified, and phenol-modified silicone oils; and nonreactive silicone oils such as polyether-modified, methylstyryl-modified, alkyl-modified, ester-modified, and fluorine-modified silicone oils. These silicone oils may be used alone or in combination of two or more thereof. Of these, nonreactive silicone oils are preferred from the viewpoint of chemical stability, and polyether-modified silicone oils are more preferred.

The content of the silicone oil in the undercoat layer is preferably 0.01% by mass or more and 10% by mass or less relative to the total mass of the particles. The content of the silicone oil in the undercoat layer is more preferably 0.1% by mass or more and 3% by mass or less. Ghosts can be more effectively suppressed within this range.

The undercoat layer can be formed by forming a coating film of a coating liquid for an undercoat layer, the coating liquid containing a composition that contains an electron transport material, particles, a silicone oil, etc., and drying the coating film. Alternatively, the undercoat layer can be formed by forming a coating film of a coating liquid for an undercoat layer, the coating liquid containing a composition that contains an electron transport material and a crosslinking agent, particles, a silicone oil, etc., and drying the coating film. These compositions are each polymerized during drying of the coating film of the coating liquid for an undercoat layer. In this case, the polymerization reaction (curing reaction) is accelerated by applying energy such as heat or light.

(4) Crosslinking Agent

In the present disclosure, the composition containing an electron transport material may further contain a crosslinking agent. That is, the undercoat layer may contain a cured product of a composition that contains an electron transport material and a crosslinking agent.

Any known material can be used as the crosslinking agent. Specifically, examples of the crosslinking agent include compounds described in "Kakyozai Handbook (Handbook of crosslinking agents)" edited by Shinzo Yamashita and Tousuke Kaneko and published by Taiseisha Ltd. (1981). In the present disclosure, the crosslinking agent preferably has a polymerizable functional group.

In the present disclosure, preferred examples of the crosslinking agent include isocyanate compounds and amino compounds. Of these, an isocyanate compound having an isocyanate group or a blocked isocyanate group or an amine compound having an N-methylol group or an alkyl-etherified N-methylol group is more preferred.

Examples of commercially available crosslinking agents include SUPER MELAMI No. 90 (manufactured by NOF Corporation); SUPER BECKAMINE (registered trademark) TD-139-60, L-105-60, L127-60, L110-60, J-820-60, G-821-60, L-148-55, 13-535, L-145-60, and TD-126 (manufactured by DIC Corporation); U-VAN 2020 (manufactured by Mitsui Chemicals, Inc.); Sumitex Resin M-3 (manufactured by Sumitomo Chemical Industry Co., Ltd.); NIKALAC MW-30, MW-390, MX-750LM, BL-60, BX-4000, MX-280, MX-270, and MX-290 (manufactured by Nippon Carbide Industries Co., Inc.); and DURANATE MF-K60B, MF-B60B, 17B-60P, SBN-70D, and SBB-70P (manufactured by Asahi Kasei Corporation).

(5) Resin

In the present disclosure, the composition containing an electron transport material may further contain a resin. That is, the undercoat layer may contain a cured product of a composition containing an electron transport material and a resin. In particular, the undercoat layer may contain a cured product of a composition containing an electron transport material, a crosslinking agent, and a resin.

The resin preferably has a weight-average molecular weight (Mw) of 5,000 or more and 400,000 or less.

The resin is preferably a thermoplastic resin. Examples of the thermoplastic resin include polyacetal resins, polyolefin resins, polyester resins, polyether resins, and polyamide resins. Furthermore, the resin preferably has a polymerizable functional group. Examples of the polymerizable functional group include a hydroxy group, a thiol group, an amino group, a carboxyl group, and a methoxy group. That is, the resin preferably has a structural unit represented by a general formula below.

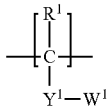

In the general formula, $R^1$ represents a hydrogen atom of an alkyl group; $Y^1$ represents a single bond, an alkylene group, or a phenylene group; and $W^1$ represents a hydroxy group, a thiol group, an amino group, a carboxyl group, or a methoxy group.

Examples of commercially available thermoplastic resins having polymerizable functional groups include polyether polyol resins such as AQD-457 and AQD-473 (manufactured by Nippon Polyurethane Industry Co., Ltd.) and SANNIX GP-400 and GP-700 (manufactured by Sanyo Chemical Industries, Ltd.); polyester polyol resins such as PHTHALKYD W2343 (manufactured by Hitachi Chemical Co., Ltd.), WATERSOL S-118 and CD-520 and BECKOLITE M-6402-50 and M-6201-401M (manufactured by DIC Corporation), HARIDIP WH-1188 (manufactured by Harima Chemicals Group, Inc.), and ES3604 and ES6538 (manufactured by Japan U-pica Co., Ltd.); polyacrylic polyol resins such as BURNOCK WE-300 and WE-304 (manufactured by DIC Corporation); polyvinyl alcohol resins such as KURARAY POVAL PVA-203 (manufactured by Kuraray Co., Ltd.); polyvinyl acetal resins such as BX-1, BM-1, and KS-5 (manufactured by Sekisui Chemical Co., Ltd.); polyamide resins such as Toresin FS-350 (manufactured by Nagase ChemteX Corporation); carboxyl group-containing resins such as ARUFON3920 (manufactured by Toagosei Co., Ltd.) and X-200 (manufactured by Seiko PMC Corporation); polyamine resins such as LUCKAMIDE (manufactured by DIC Corporation); and polythiol resins such as QE-340M (manufactured by Toray Industries, Inc.). Of these, polyvinyl acetal resins having polymerizable functional groups, polyester polyol resins having polymerizable functional groups, carboxyl group-containing resins, and the like are more preferred from the viewpoints of polymerizability and evenness of the undercoat layer.

(6) Others

In the present disclosure, the undercoat layer may further contain compounds represented by formulae (A) and (B) (also referred to as "compound (A)" and "compound (B)", respectively). The compounds (A) and (B) and the electron transport material form hydrogen bonds to suppress aggregation of the electron transport material, and internal stress is thereby relieved. In addition, the compounds (A) and (B), which have high polarity, increase the polarity of the undercoat layer and accelerate uneven distribution of the silicone oil, which has low polarity, between the particles. Thus, a higher effect of reducing ghosts is presumably achieved.

(A)

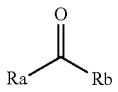

In formula (A), $R_a$ and $R_b$ each independently represent a substituted or unsubstituted alkyl group having 3 or less carbon atoms, and the substituent of the substituted alkyl group is a methyl group.

(B)

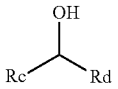

In formula (B), $R_c$ and $R_d$ each independently represent a hydrogen atom or a substituted or unsubstituted alkyl group having 4 or less carbon atoms, and the substituent of the substituted alkyl group is a methyl group.

Specific examples of the compound represented by formula (A) include acetone, methyl ethyl ketone, 3-methyl-2-butanone, and 3-pentanone. Specific examples of the compound represented by formula (B) include 1-propanol, 2-propanol, 1-butanol, and 2-pentanol.

The content of the compound represented by formula (A) in the undercoat layer is preferably 0.1 ppm or more and 5.0 ppm or less. The content of the compound represented by formula (B) in the undercoat layer is preferably 0.1 ppm or more and 5.0 ppm or less.

Step of Forming Undercoat Layer

A method for producing an electrophotographic photosensitive member according to an embodiment of the present disclosure may include a step of forming an undercoat layer by drying a coating film of a coating liquid for an undercoat layer by heating.

The coating liquid for an undercoat layer may contain an electron transport material, particles having an average primary particle size of 10 nm or more, a silicone oil, a compound represented by formula (A), and a compound represented by formula (B).

A ratio of the particles to the total solid content in the coating liquid for an undercoat layer is 3% by mass or more and 20% by mass or less. In this case, the solid content in the coating liquid for an undercoat layer means a total content of the electron transport material, the particles having an average primary particle size of 10 nm or more, a cross-linking agent, and a resin.

The content of the silicone oil in the coating liquid for an undercoat layer may be 0.01% by mass or more and 10% by mass or less relative to the content of the particles.

Examples of a solvent used in the coating liquid for an undercoat layer include alcohol solvents, sulfoxide solvents, ketone solvents, ether solvents, ester solvents, and aromatic hydrocarbon solvents. Of these, alcohol solvents and ketone solvents are preferred. Furthermore, acetone, methyl ethyl ketone, 1-butanol, 1-propanol, 2-propanol, and 1-methoxy-2-propanol are preferably used. The solvents selected here remain in the undercoat layer after the formation of the undercoat layer to exhibit, as the compounds (A) and (B) described above, the action of improving the effect of the present disclosure.

In this case, the content of the compound represented by formula (A) in the coating liquid for an undercoat layer may be 0.3 times or more and 3.0 times or less the content of the compound represented by formula (B) in terms of mass ratio.

Overall Structure of Electrophotographic Photosensitive Member

Figure 4:
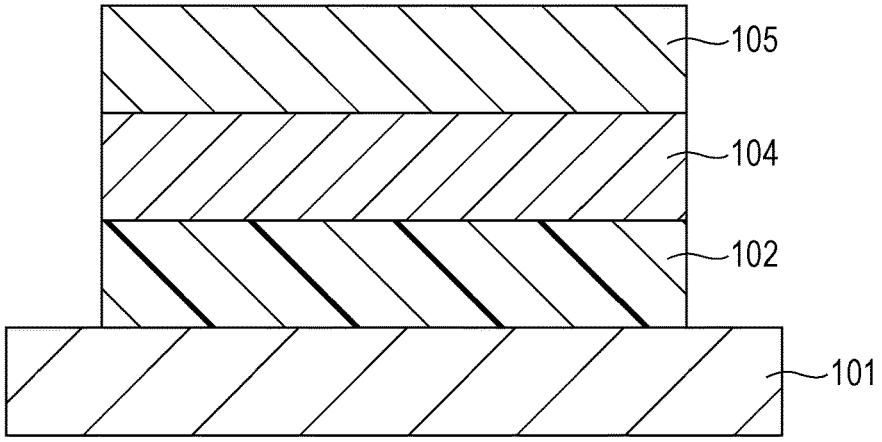
FIG. 4 is a view illustrating an example of a layer structure of an electrophotographic photosensitive member.

FIG. 4 is a view illustrating an example of a layer structure of an electrophotographic photosensitive member. Referring to FIG. 4, a support 101, an undercoat layer 102 on the support 101, a charge generation layer 104 on the undercoat layer 102, and a charge transport layer 105 on the charge generation layer 104 are formed. Specifically, the electrophotographic photosensitive member includes the support 101, the undercoat layer 102, the charge generation layer 104, and the charge transport layer 105 in that order.

A cylindrical electrophotographic photosensitive member including a cylindrical support and photosensitive layers (a charge generation layer and a charge transport layer) formed on the support is widely used as a typical electrophotographic photosensitive member. The electrophotographic photosensitive member according to an embodiment of the present disclosure can also be a cylindrical electrophotographic photosensitive member. Alternatively, the electrophotographic photosensitive member may have a belt shape, a sheet shape, or the like.

Support

The support may be a support having electroconductivity (conductive support). For example, a support made of a metal such as aluminum, nickel, copper, gold, or iron or an alloy thereof may be used.

Alternatively, a support obtained by forming a thin film made of a conductive material such as a metal or a metal oxide on an insulating support may be used as the conductive support. Examples thereof include a support obtained by forming a thin film made of a metal such as aluminum, silver, or gold on an insulating support made of a polyester resin, a polycarbonate resin, a polyimide resin, or glass, and a support obtained by forming a thin film made of a conductive material such as indium oxide or tin oxide on such an insulating support.

The surface of the support may be subjected to an electrochemical treatment such as anodization, a wet honing treatment, a blasting treatment, or a cutting treatment to improve the electrical properties and suppress the occurrence of interference fringes.

Conductive Layer

A conductive layer may be disposed between the support and an undercoat layer described below. The conductive layer is obtained by forming, on the support, a coating film of a coating liquid for a conductive layer, the coating liquid containing a resin and conductive particles dispersed in the resin, and drying the coating film.

Examples of the conductive particles include carbon black, acetylene black, metal powders such as aluminum, nickel, iron, Nichrome, copper, zinc, and silver powders, and metal oxide powders such as conductive tin oxide and indium tin oxide (ITO) powders.

Examples of the resin include polyester resins, polycarbonate resins, polyvinyl butyral resins, acrylic resins, silicone resins, epoxy resins, melamine resins, urethane resins, phenolic resins, and alkyd resins.

Examples of a solvent for preparing the coating liquid for a conductive layer include ether solvents, alcohol solvents, ketone solvents, and aromatic hydrocarbon solvents.

The thickness of the conductive layer is preferably 0.2 μm or more and 40 μm or less, more preferably 1 μm or more and 35 μm or less, and still more preferably 5 μm or more and 30 μm or less.

Charge Generation Layer

A charge generation layer is disposed directly on the undercoat layer. Examples of a charge generation material include azo pigments, perylene pigments, anthraquinone derivatives, anthanthrone derivatives, dibenzpyrenequinone derivatives, pyranthrone derivatives, quinone pigments, indigoid pigments, phthalocyanine pigments, and perinone pigments. Of these, phthalocyanine pigments are preferred. Among phthalocyanine pigments, oxytitanium phthalocyanine, chlorogallium phthalocyanine, and hydroxygallium phthalocyanine are preferred.

Examples of a binder resin used in the charge generation layer include polymers and copolymers of vinyl compounds such as styrene, vinyl acetate, vinyl chloride, acrylic acid esters, methacrylic acid esters, vinylidene fluoride, and trifluoroethylene; polyvinyl alcohols; polyvinyl acetals; polycarbonates; polyesters; polysulfones; polyphenylene oxides; polyurethanes; cellulose resins; phenolic resins; melamine resins; silicone resins; and epoxy resins. Of these, polyesters, polycarbonates, and polyvinyl acetals are preferred.

A ratio of the charge generation material to the binder resin (charge generation material/binder resin) in the charge generation layer is preferably in the range of 10/1 to 1/10 and more preferably in the range of 5/1 to 1/5.

Examples of a solvent used for preparing a coating liquid for a charge generation layer include alcohol solvents, ketone solvents, ether solvents, ester solvents, and aromatic hydrocarbon solvents.

The thickness of the charge generation layer is preferably 0.05 μm or more and 5 μm or less.

Charge Transport Layer

A charge transport layer is formed on the charge generation layer. Examples of a charge transport material include hydrazone compounds, styryl compounds, benzidine compounds, butadiene compounds, enamine compounds, triarylamine compounds, and triphenylamine. Examples thereof further include polymers having a group derived from any of these compounds in the main chain or a side chain thereof.

Examples of a binder resin used in the charge transport layer include polyesters, polycarbonates, polymethacrylic acid esters, polyarylates, polysulfones, and polystyrenes. Of these, polycarbonates and polyarylates are preferred. These binder resins preferably have a weight-average molecular weight (Mw) in the range of 10,000 to 300,000.

A ratio of the charge transport material to the binder resin (charge transport material/binder resin) in the charge transport layer is preferably in the range of 10/5 to 5/10 and more preferably in the range of 10/8 to 6/10.

The thickness of the charge transport layer is preferably 5 μm or more and 40 μm or less.

Examples of a solvent used for preparing a coating liquid for a charge transport layer include alcohol solvents, ketone solvents, ether solvents, ester solvents, and aromatic hydrocarbon solvents.

Other Layers

Another layer, such as a second undercoat layer which is not included in the range of the undercoat layer in the present disclosure, may further be disposed between the support and the undercoat layer either separately from or in addition to the conductive layer described above.

Furthermore, a protective layer containing conductive particles or a charge transport material and a binder resin may be disposed on the charge transport layer. The protective layer may further contain an additive such as a lubricant. The binder resin of the protective layer may be provided with electroconductivity or a charge-transporting capability. In such a case, there is no need to incorporate conductive particles or a charge transport material other than the binder resin in the protective layer. The binder resin of the protective layer may be a thermoplastic resin or a cured resin cured by heat, light, radiation (such as an electron beam), or the like.

Method for Forming Layers

The method for forming layers, such as the undercoat layer, the charge generation layer, the charge transport layer, and the conductive layer, which form an electrophotographic photosensitive member may be a method described below. Specifically, the method for forming the layers includes applying coating liquids prepared by dissolving and/or dispersing materials constituting the respective layers in respective solvents and drying and/or curing the resulting coating films. Examples of the method for applying the coating liquids include a dip coating method (dip coating), a spray coating method, a curtain coating method, and a spin coating method. Of these, a dip coating method is preferred from the viewpoints of efficiency and productivity.

Process Cartridge and Electrophotographic Apparatus

FIG. 1 illustrates a schematic structure of an electrophotographic apparatus including a process cartridge provided with an electrophotographic photosensitive member.

Referring to FIG. 1, a cylindrical electrophotographic photosensitive member 1 is driven for rotation about a shaft 2 at a predetermined circumferential velocity in the direction indicated by the arrow. The surface (peripheral surface) of the electrophotographic photosensitive member 1 driven for rotation is charged to a predetermined positive or negative potential by a charging device 3 (for example, a contact charger or a noncontact charger). Subsequently, the surface is exposed with exposure light (image exposure light) 4 from an exposure device (not shown) such as a slit exposure or laser beam scanning exposure device. Thus, electrostatic latent images corresponding to desired images are successively formed on the surface of the electrophotographic photosensitive member 1.

The electrostatic latent images formed on the surface of the electrophotographic photosensitive member 1 are then developed with a toner contained in a developer in a developing device 5 to form toner images. The toner images formed and carried on the surface of the electrophotographic photosensitive member 1 are successively transferred to a transfer medium (such as a paper sheet) P by a transfer bias from a transfer device (such as a transfer roller) 6. The transfer medium P is fed to a nip (contact portion) between the electrophotographic photosensitive member 1 and the transfer device 6 from a transfer medium feeding device (not shown) in synchronization with the rotation of the electrophotographic photosensitive member 1.

The transfer medium P to which the toner images have been transferred is separated from the surface of the electrophotographic photosensitive member 1 and guided to a fixing device 8 where the toner images are fixed. Thus, the transfer medium P is output from the apparatus as an image-formed product (a print or a copy).

The surface of the electrophotographic photosensitive member 1 after the transfer of the toner images is cleaned with a cleaning device (such as a cleaning blade) 7 to remove the developer (residual toner) that remains after the transfer. Subsequently, the surface of the electrophotographic photosensitive member 1 is subjected to a static elimination treatment by being irradiated with pre-exposure light (not shown) from a pre-exposure device (not shown) and is then repeatedly used for forming images. When the charging device 3 is a contact-charging device using a charging roller as illustrated in FIG. 1, the pre-exposure is not essential.

The electrophotographic photosensitive member 1 and at least one device selected from the group consisting of the charging device 3, the developing device 5, the transfer device 6, and the cleaning device 7 may be housed in a container so as to be integrally supported as a process cartridge. The process cartridge may be configured to be detachably attachable to a main body of an electrophotographic apparatus. In FIG. 1, the electrophotographic photosensitive member 1, the charging device 3, the developing device 5, and the cleaning device 7 are integrally supported to form a process cartridge 9 that is detachably attachable to the main body of the electrophotographic apparatus by using a guiding device 10 such as rails of the main body of the electrophotographic apparatus.

EXAMPLES

The present disclosure will now be described in more detail by way of Examples. In the description of Examples below, the term "part" refers to "part by mass".

A synthesis example of an electron transport material will be described.

Synthesis Example 1

In a 500-mL three-neck flask, 26.8 g (100 mmol) of naphthalene-1,4,5,8-tetracarboxylic dianhydride and 250 mL of dimethylacetamide were put at room temperature in a nitrogen gas stream. The resulting mixture was heated to 120° C., and 11.6 g (100 mmol) of 4-heptylamine was then added dropwise thereto under stirring. After the completion of the dropwise addition, the mixture was stirred for three hours.

Subsequently, a mixture of 9.2 g (100 mmol) of 2-amino-1,3-propanediol and 50 mL of dimethylacetamide was added dropwise under stirring. After the completion of the dropwise addition, the resulting mixture was heated and refluxed for six hours. After the completion of the reaction, the container was cooled, and the resulting reaction mixture was vacuum-concentrated. Ethyl acetate was added to the residue, and the resulting mixture was then filtered. The filtrate was purified by silica gel column chromatography. Furthermore, the collected product was recrystallized with ethyl acetate/hexane to obtain 10.5 g of an electron transport material represented by formula (A1-1) shown in Table 1.

The above compound was analyzed by MALDI-TOF MS (matrix-assisted laser desorption/ionization time-of-flight mass spectrometry). The results showed a peak top value of 438.

Next, production and evaluations of electrophotographic photosensitive members will be described.

Example 1

An aluminum cylinder (JIS-A3003, aluminum alloy) having a length of 260.5 mm and a diameter of 30 mm was used as a support (conductive support).

Next, 214 parts of titanium oxide ($TiO_2$) particles coated with oxygen-deficient tin oxide ($SnO_2$) and serving as metal oxide particles, 132 parts of a phenolic resin (trade name: PLYOPHEN J-325, manufactured by DIC Corporation, resin solid content: 60% by mass) serving as a binder resin, and 98 parts of 1-methoxy-2-propanol were charged in a sand mill with 450 parts of glass beads having a diameter of 0.8 mm. A dispersion treatment was conducted under the conditions of a rotation speed of 2,000 rpm, a dispersion treatment time of 4.5 hours, and a cooling water setting temperature of 18° C. to prepare a dispersion liquid. The glass beads were removed from the dispersion liquid with a mesh (sieve opening: 150 μm).

Silicone resin particles (trade name: Tospearl 120, manufactured by Momentive Performance Materials Japan LLC) were added to the dispersion liquid so that the amount of the silicone resin particles was 10% by mass relative to the total mass of the metal oxide particles and the binder resin in the dispersion liquid after the removal of the glass beads. In addition, a silicone oil (trade name: SH28PA, manufactured by Dow Corning Toray Co., Ltd.) was added to the dispersion liquid so that the amount of the silicone oil was 0.01% by mass relative to the total mass of the metal oxide particles and the binder resin in the dispersion liquid. The resulting mixture was stirred to prepare a coating liquid for a conductive layer. The coating liquid for a conductive layer was applied to the support by dip coating to form a coating film. The coating film was dried and thermally cured at 150° C. for 30 minutes to form a conductive layer having a thickness of 30 μm.

Next, 3.28 parts of Exemplary compound (A1-1) shown in Table 1 and serving as an electron transport material, 0.22 parts of a polyolefin resin (trade name: UC-3920, manufactured by Toagosei Co., Ltd.), 0.22 parts of a polyvinyl acetal resin (trade name: KS-5Z, manufactured by Sekisui Chemical Co., Ltd.), and 6.28 parts of a blocked isocyanate compound (trade name: SBB-70P, manufactured by Asahi Kasei Corporation) were dissolved in a mixed solvent of 40 parts of acetone and 60 parts of 1-butanol. A silica slurry (trade name: IPA-ST-UP, manufactured by Nissan Chemical Corporation, solid content: 15% by mass, viscosity: 9 mPa·s) in which silica particles were dispersed in isopropyl alcohol was added to the resulting solution so that the amount of the slurry was 6% by mass relative to the total mass of the binder resins and the particles after curing. Furthermore, a silicone oil (trade name: SH28PA, manufactured by Dow Corning Toray Co., Ltd.) was added so that the amount of the silicone oil was 2% by mass relative to the mass of the particles, and the resulting mixture was stirred for one hour. The mixture was then filtered under pressure through a Teflon filter (trade name: PF020) manufactured by ADVANTEC.

A coating liquid for an undercoat layer prepared as described above was applied to the conductive layer by dip coating. The resulting coating film was cured (polymerized) by being heated at 170° C. for 30 minutes. As a result, an undercoat layer having a thickness of 0.7 μm was formed.

Next, hydroxygallium phthalocyanine crystals (charge generation material) with a crystal form having intense peaks at Bragg angles (2θ±0.2°) of 7.5°, 9.9°, 12.5°, 16.3°, 18.6°, 25.1°, and 28.3° in CuKα characteristic X-ray diffraction was prepared. Next, 10 parts of the hydroxygallium phthalocyanine crystals, 5 parts of a polyvinyl butyral resin (trade name: S-LEC BX-1, manufactured by Sekisui Chemical Co., Ltd.), and 250 parts of cyclohexanone were charged in a sand mill with glass beads having a diameter of 1 mm and subjected to a dispersion treatment for two hours. Subsequently, 250 parts of ethyl acetate was added to the resulting dispersion liquid to prepare a coating liquid for a charge generation layer. The coating liquid for a charge generation layer was applied to the undercoat layer by dip coating to form a coating film. The coating film was dried at 95° C. for 10 minutes to form a charge generation layer having a thickness of 0.15 μm.

Next, 6 parts of an amine compound (hole transport material) represented by formula (2) below, 2 parts of an amine compound (hole transport material) represented by formula (3) below, and 10 parts of a polyester resin having structural units represented by formulae (4) and (5) below at a ratio of 5/5 and having a weight-average molecular weight (Mw) of 100,000 were dissolved in a mixed solvent of 40 parts of dimethoxymethane and 60 parts of chlorobenzene to prepare a coating liquid for a hole transport layer.

(2)

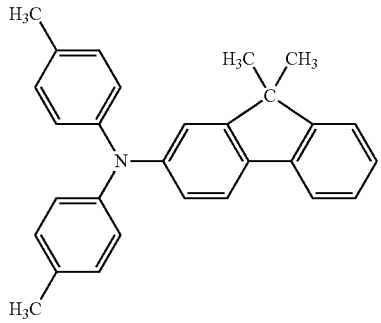

(3)

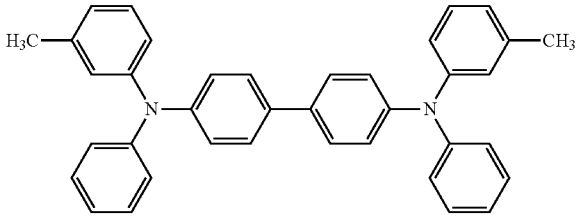

(4)

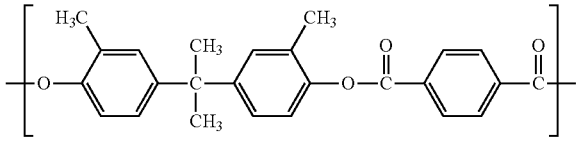

(5)

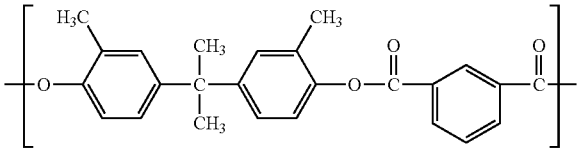

The coating liquid for a hole transport layer was applied to the charge generation layer by dip coating, and the resulting coating film was dried at 120° C. for 40 minutes to form a hole transport layer having a thickness of 23 μm.

As described above, an electrophotographic photosensitive member including a conductive layer, an undercoat layer, a charge generation layer, and a charge transport layer that were disposed in that order on a support was produced.

Evaluation of Sensitivity

An electrophotographic photosensitive member for evaluating sensitivity was mounted on an apparatus prepared by modifying a laser beam printer (trade name: LBP-2510) manufactured by CANON KABUSHIKI KAISHA, and process conditions described below were determined. Subsequently, a surface potential (electric potential change) was evaluated. The laser beam printer was modified so that the process speed was 200 mm/s, a dark-area potential was −700 V, and the light quantity of exposure light (image exposure light) was variable. Specifically, the evaluation was performed as follows.

In an environment at a temperature of 23° C. and a humidity of 50% RH, a development cartridge was removed from the evaluation apparatus, and a potential measuring device was inserted into the space from which the development cartridge was removed to measure the surface potential. The potential measuring device was configured to arrange a potential measurement probe at a development position of the development cartridge. The potential measurement probe was positioned at the center of the electrophotographic photosensitive member in the axial direction of the drum. The sensitivity was evaluated by a light-area potential when irradiation was performed with the same quantity of light. A low light-area potential is evaluated as a high sensitivity, and a high light-area potential is evaluated as a low sensitivity. The light quantity was set to 0.3 $\mu J/cm^2$, and the light-area potential (VI) was measured. Table 2 shows the evaluation results of the sensitivity.

Evaluation of Positive Ghost

An electrophotographic photosensitive member for evaluating a positive ghost was mounted on an apparatus prepared by modifying a laser beam printer (trade name: LBP-2510) manufactured by CANON KABUSHIKI KAISHA, and process conditions described below were determined. Subsequently, a surface potential (electric potential change) was evaluated. The laser beam printer was modified so that the process speed was 200 mm/s, a dark-area potential was −700 V, and the light quantity of exposure light (image exposure light) was variable. Specifically, the evaluation was performed as follows.

In an environment at a temperature of 23° C. and a humidity of 50% RH, the electrophotographic photosensitive member produced above was mounted on a process cartridge for the cyan color of the laser beam printer, the process cartridge being modified so as to increase the stress applied to the electrophotographic photosensitive member by a cleaning blade. The resulting process cartridge was mounted on a station of a cyan process cartridge, and images were then output. Specifically, one sheet with a solid white image, five sheets with an image for evaluating a ghost, one sheet with a solid black image, and five sheets with the image for evaluating a ghost were continuously output in that order.

Figure 2:
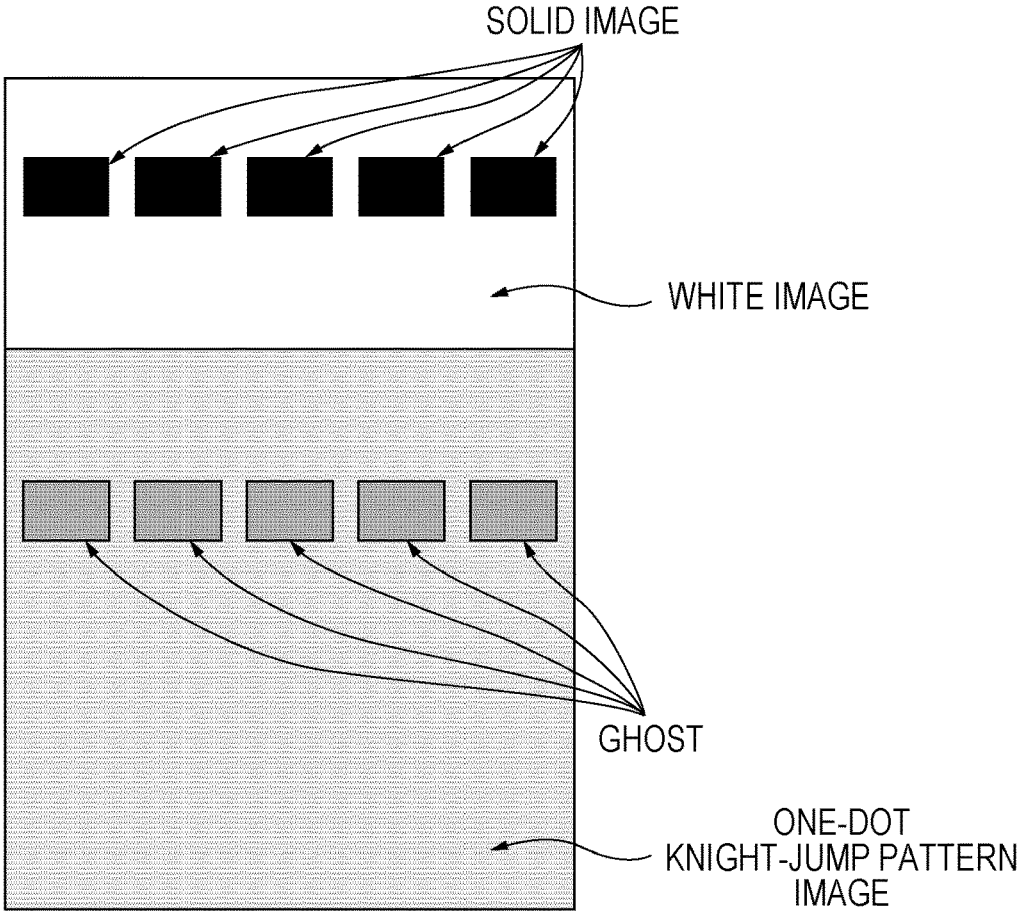
FIG. 2 is a view for explaining printing for a ghost evaluation used in a ghost image evaluation.
Figure 3:
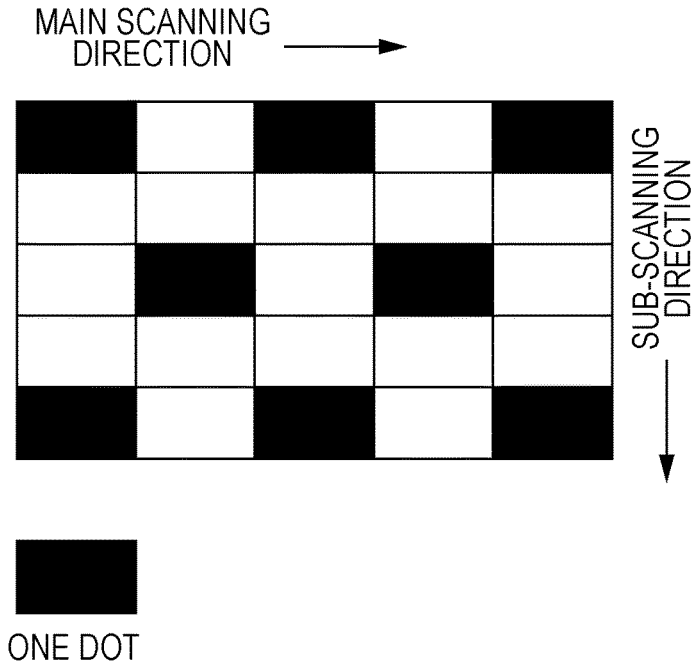
FIG. 3 is a view for explaining a one-dot knight-jump pattern image.

As illustrated in FIG. 2, the image for evaluating a ghost is an image in which after quadrangular "solid images" are output on a "white image" in a leading end portion of the image, a "one-dot knight-jump pattern halftone image" illustrated in FIG. 3 is formed. In FIG. 2, portions marked as "GHOST" are portions where ghosts due to the "solid images" may appear.

The evaluation of the positive ghost was performed by measuring differences in image density between the one-dot knight-jump pattern halftone image and the ghost portions. The differences in image density were measured with a spectrodensitometer (trade name: X-Rite 504/508, manufactured by X-Rite Inc.) at 10 points in one sheet of the image for evaluating a ghost. This operation was performed for all the 10 sheets of the image for evaluating a ghost to calculate the average of a total of 100 points.

A difference in Macbeth density (initial) was evaluated at the time of the initial image output. Next, a difference (variation) between a difference in Macbeth density after the output of 5,000 sheets and the difference in Macbeth density at the time of the initial image output was calculated to determine a variation in difference in Macbeth density. Table 2 shows the evaluation results of the positive ghost. The smaller the difference in Macbeth density, the more the positive ghost is suppressed. The smaller the difference between the difference in Macbeth density after the output of 5,000 sheets and the difference in Macbeth density at the time of the initial image output, the smaller the variation in the positive ghost.

The ghost images were classified into the following levels. The levels D and E were determined to be insufficient in the effect of the present disclosure.

Level A: No ghost is observed in any of the image for evaluating a ghost.

Level B: A ghosts is slightly observed in some of the images for evaluating a ghost.

Level C: A ghost is slightly observed in all the images for evaluating a ghost.

Level D: A ghost is observed in some of the images for evaluating a ghost.

Level E: A ghost is observed in all the images for evaluating a ghost.

Examples 2 to 31

Electrophotographic photosensitive members were produced as in Example 1 except that the type of the electron transport material mixed in the coating liquid for an undercoat layer, the types and amounts of the particles and the silicone oil, and the thickness of the undercoat layer were changed as shown in Table 2. The evaluations were conducted in the same manner. Table 2 shows the results.

Example 32

An electrophotographic photosensitive member was produced as in Example 1 except that the thickness of the undercoat layer was 4.0 μm. The evaluations were conducted in the same manner. Table 2 shows the results.

Examples 33 to 45

Electrophotographic photosensitive members were produced as in Example 32 except that the type of the electron transport material mixed in the coating liquid for an undercoat layer, the types and amounts of the particles and the silicone oil, and the thickness of the undercoat layer were changed as shown in Table 2. The evaluations were conducted in the same manner. Table 2 shows the results.

Examples 46 to 53

Electrophotographic photosensitive members were produced as in Example 32 except that an aluminum cylinder (JIS-A3003, aluminum alloy) having a length of 260.5 mm and a diameter of 30 mm and subjected to a honing treatment and ultrasonic washing was used as a support (conductive support), and an undercoat layer was formed without forming a conductive layer. The evaluations were conducted in the same manner. Table 2 shows the results.

Example 54

An electrophotographic photosensitive member was produced as in Example 1 except that the thickness of the undercoat layer was 2.0 μm.

Measurement of Solvent Contained

The contents in the undercoat layer were determined by a measurement method described below.

The measurement was conducted by using an HP7694 Headspace sampler (manufactured by Agilent Technologies) and an HP6890 series GC System (manufactured by Agilent Technologies). In the Headspace sampler, Oven was set to 190° C., Loop was set to 190° C., and Transfer Line was set to 190° C. The charge transport layer and the charge generation layer of the electrophotographic photosensitive member prepared above were removed and cut to prepare a specimen, and the specimen was placed in a vial. The vial was set in the Headspace sampler, and a generated gas was analyzed by gas chromatography (HP6890 series GC System).

Evaluation in Low-Temperature, Low-Humidity Environment

The sensitivity and the positive ghost were evaluated as in Example 1 except that the evaluations were conducted in an environment at a temperature of 15° C. and a humidity of 10% RH. Table 3 shows the evaluation results.

Examples 55 to 66

Electrophotographic photosensitive members were produced as in Example 54 except that the type and the amount of the solvent mixed in the coating liquid for an undercoat layer and the drying temperature of the undercoat layer were changed as shown in Table 3. The evaluations were conducted in the same manner. Table 3 shows the evaluation results.

Comparative Example 1

An electrophotographic photosensitive member was produced as in Example 1 except that an undercoat layer was formed by using a coating liquid for an undercoat layer prepared as described below. The evaluations were conducted in the same manner. Table 4 shows the results.

In a mixed solvent of 48 parts of 1-methoxy-2-propanol and 48 parts of tetrahydrofuran, 4.6 parts of a compound represented by formula (7) and serving as an electron transport material and 8.6 parts of a blocked isocyanate compound (trade name: SBN-70D, manufactured by Asahi Kasei Corporation) were dissolved. Furthermore, 0.3 parts of silica particles (trade name: RX200, manufactured by Nippon Aerosil Co., Ltd.) were added thereto, and the resulting mixture was stirred to prepare a coating liquid for an undercoat layer. The coating liquid for an undercoat layer was applied to a support by dip coating. The resulting coating film was polymerized by being heated at 170° C. for 20 minutes. As a result, an undercoat layer having a thickness of 0.7 μm was formed.

(7)

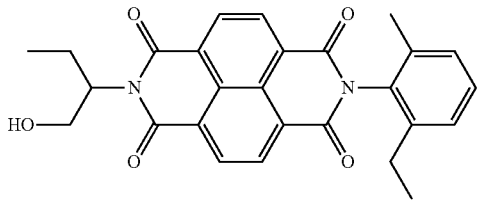

Comparative Example 2

An electrophotographic photosensitive member was produced as in Example 1 except that an undercoat layer was formed by using a coating liquid for an undercoat layer prepared as described below. The evaluations were conducted in the same manner. Table 4 shows the results.

In a mixed solvent of 48 parts of 1-methoxy-2-propanol and 48 parts of tetrahydrofuran, 10 parts of the compound represented by formula (7) and serving as an electron transport material and 8.6 parts of a blocked isocyanate compound (trade name: SBN-70D, manufactured by Asahi Kasei Corporation) were dissolved. Furthermore, 0.6 parts of silica particles (trade name: RX200, manufactured by Nippon Aerosil Co., Ltd.) were added thereto, and the resulting mixture was stirred to prepare a coating liquid for an undercoat layer. The coating liquid for an undercoat layer was applied to a support by dip coating. The resulting coating film was polymerized by being heated at 170° C. for 20 minutes. As a result, an undercoat layer having a thickness of 4 μm was formed.

Comparative Example 3

An electrophotographic photosensitive member was produced as in Comparative Example 2 except that an aluminum cylinder (JIS-A3003, aluminum alloy) having a length of 260.5 mm and a diameter of 30 mm and subjected to a honing treatment and ultrasonic washing was used as a support (conductive support), and an undercoat layer was formed without forming a conductive layer. The evaluations were conducted in the same manner. Table 4 shows the results.

Comparative Example 4

An electrophotographic photosensitive member was produced as in Example 1 except that an undercoat layer was formed by using a coating liquid for an undercoat layer prepared as described below. The evaluations were conducted in the same manner. Table 4 shows the results.

In a mixed solvent of 50 parts of dimethylacetamide and 50 parts of methyl ethyl ketone, 4 parts of the compound represented by formula (7) and serving as an electron transport material, 0.3 parts of a polyvinyl acetal resin (trade name: S-LEC KS-5Z, manufactured by Sekisui Chemical Co., Ltd.), 5.5 parts of a blocked isocyanate compound (trade name: SBN-70D, manufactured by Asahi Kasei Corporation), and 0.08 parts of zinc(H) hexanoate (trade name: zinc(II) hexanoate, manufactured by Mitsuwa Chemicals Co., Ltd.) were dissolved. Furthermore, 1.5 parts of silicone resin particles (trade name: Tospearl 120, manufactured by Momentive Performance Materials Inc.) were added thereto, and the resulting mixture was stirred to prepare a coating liquid for an undercoat layer. The coating liquid for an undercoat layer was applied to a support by dip coating. The resulting coating film was polymerized by being heated at 160° C. for 40 minutes. As a result, an undercoat layer having a thickness of 4 μm was formed.

Comparative Example 5

An electrophotographic photosensitive member was produced as in Comparative Example 4 except that an aluminum cylinder (JIS-A3003, aluminum alloy) having a length of 260.5 mm and a diameter of 30 mm and subjected to a honing treatment and ultrasonic washing was used as a support (conductive support), and an undercoat layer was formed without forming a conductive layer. The evaluations were conducted in the same manner. Table 4 shows the results.

Comparative Example 6

An electrophotographic photosensitive member was produced as in Example 54 except that an undercoat layer was formed by using a coating liquid for an undercoat layer prepared as described below. The evaluations were conducted in the same manner. Table 4 shows the results.

In a mixed solvent of 48 parts of 1-methoxy-2-propanol and 48 parts of tetrahydrofuran, 4.6 parts of the compound represented by formula (7) and serving as an electron transport material and 8.6 parts of a blocked isocyanate compound (trade name: SBN-70D, manufactured by Asahi Kasei Corporation) were dissolved. Furthermore, 0.3 parts of silica particles (trade name: RX200, manufactured by Nippon Aerosil Co., Ltd.) were added thereto, and the resulting mixture was stirred to prepare a coating liquid for an undercoat layer. The coating liquid for an undercoat layer was applied to a support by dip coating. The resulting coating film was polymerized by being heated at 170° C. for 20 minutes. As a result, an undercoat layer having a thickness of 2.0 μm was formed.

Comparative Example 7

An electrophotographic photosensitive member was produced as in Example 54 except that an undercoat layer was formed by using a coating liquid for an undercoat layer prepared as described below. The evaluations were conducted in the same manner. Table 4 shows the results.

In a mixed solvent of 50 parts of 1-methoxy-2-propanol and 50 parts of tetrahydrofuran, 5.0 parts of the compound represented by Exemplary compound (A1-7) and serving as an electron transport material, 0.6 parts of a polyvinyl acetal resin (trade name: S-LEC KS-5Z, manufactured by Sekisui Chemical Co., Ltd.), 8.6 parts of a blocked isocyanate compound (trade name: SBN-70D, manufactured by Asahi Kasei Corporation), and 0.15 parts of zinc(II) hexanoate (trade name: zinc(II) hexanoate, manufactured by Mitsuwa Chemicals Co., Ltd.) were dissolved. Furthermore, 0.3 parts of silica particles (trade name: RX200, manufactured by Nippon Aerosil Co., Ltd.) were added thereto, and the resulting mixture was stirred to prepare a coating liquid for an undercoat layer. The coating liquid for an undercoat layer was applied to a support by dip coating. The resulting coating film was polymerized by being heated at 170° C. for 20 minutes. As a result, an undercoat layer having a thickness of 2.0 μm was formed.

TABLE 2

Conditions for preparation and evaluation results of photosensitive member

| Example No. | Type of electron transport material | Particles Type | Particles Particle size (nm) | Particles Content in layer (mass %) | Silicone oil Type | Silicone oil Content relative to particles (mass %) | Undercoat layer thickness (μm) | Evaluation results Sensitivity Light-area potential (−V) | Evaluation results Ghost Initial | Evaluation results Ghost Variation | Evaluation results Ghost Image level |
|---|---|---|---|---|---|---|---|---|---|---|---|
| 1 | A1-1 | Silica 1 | 60 | 6 | Polyether-modified | 2.0 | 0.7 | 115 | 0.022 | 0.001 | A |
| 2 | A1-2 | Silica 1 | 60 | 6 | Polyether-modified | 2.5 | 0.7 | 117 | 0.026 | 0.005 | A |
| 3 | A1-1 | Silica 1 | 60 | 6 | Polyether-modified | 0.5 | 0.7 | 123 | 0.030 | 0.003 | A |
| 4 | A1-1 | Silica 2 | 90 | 5 | Polyether-modified | 0.1 | 0.7 | 127 | 0.023 | 0.004 | A |
| 5 | A1-1 | Silica 2 | 90 | 10 | Polyether-modified | 1.5 | 0.7 | 118 | 0.021 | 0.004 | A |
| o | A1-8 | Silica 1 | 60 | 4 | Polyether-modified | 1.0 | 0.7 | 129 | 0.028 | 0.007 | B |
| 7 | A1-8 | Silica 1 | 60 | 4 | Polyether-modified | 5.5 | 0.7 | 158 | 0.035 | 0.012 | C |
| 8 | A1-1 | Silica 3 | 300 | 10 | Polyether-modified | 1.5 | 0.7 | 114 | 0.022 | 0.002 | A |
| 9 | A1-1 | Silica 3 | 300 | 20 | Polyether-modified | 0.5 | 0.7 | 163 | 0.036 | 0.008 | C |
| 10 | A1-2 | Silica 1 | 60 | 20 | Polyether-modified | 0.45 | 0.7 | 153 | 0.034 | 0.014 | C |
| 11 | A1-2 | Silica 1 | 60 | 3 | Polyether-modified | 1.5 | 0.7 | 115 | 0.021 | 0.002 | A |
| 12 | A1-1 | Silica 1 | 60 | 3 | Polyether-modified | 10 | 0.7 | 117 | 0.023 | 0.006 | A |
| 13 | A1-1 | Silica 1 | 60 | 20 | Polyether-modified | 0.01 | 0.7 | 166 | 0.033 | 0.011 | C |
| 14 | A1-1 | Silica 1 | 60 | 6 | Polyether-modified | 4.0 | 0.7 | 121 | 0.025 | 0.006 | A |
| 15 | A1-1 | Silica 1 | 60 | 6 | Polyether-modified | 0.02 | 0.7 | 119 | 0.023 | 0.006 | A |
| 16 | A1-1 | Titanium oxide 1 | 70 | 10 | Polyether-modified | 1.5 | 0.7 | 175 | 0.038 | 0.017 | C |
| 17 | A1-1 | Titanium oxide 2 | 250 | 10 | Polyether-modified | 1.5 | 0.7 | 177 | 0.031 | 0.023 | C |
| 18 | A1-1 | Zinc oxide | 70 | 10 | Polyether-modified | 1.5 | 0.7 | 174 | 0.036 | 0.016 | C |
| 19 | A1-1 | Silica 1 | 60 | 6 | Alkyl-modified | 2.0 | 0.7 | 163 | 0.037 | 0.013 | C |
| 20 | A1-1 | Silica 1 | 60 | 6 | Carboxyl-modified | 2.0 | 0.7 | 159 | 0.040 | 0.014 | C |
| 21 | A2-1 | Silica 1 | 60 | 6 | Polyether-modified | 2.0 | 0.7 | 119 | 0.020 | 0.003 | A |
| 22 | A2-3 | Silica 1 | 60 | 3 | Polyether-modified | 1.5 | 0.7 | 115 | 0.025 | 0.006 | A |
| 23 | A2-2 | Silica 2 | 90 | 3 | Polyether-modified | 2.0 | 0.7 | 123 | 0.029 | 0.005 | A |
| 24 | A2-1 | Silica 1 | 60 | 10 | Polyether-modified | 1.5 | 0.7 | 128 | 0.024 | 0.001 | A |
| 25 | A2-1 | Titanium oxide 1 | 70 | 10 | Polyether-modified | 1.5 | 0.7 | 179 | 0.038 | 0.021 | C |
| 26 | A2-1 | Silica 1 | 60 | 6 | Alkyl-modified | 2.0 | 0.7 | 154 | 0.039 | 0.02 | C |
| 27 | A2-1 | Silica 1 | 60 | 0 | Carboxyl-modified | 2.0 | 0.7 | 163 | 0.040 | 0.016 | C |
| 28 | A9-1 | Silica 1 | 60 | 6 | Polyether-modified | 0.5 | 0.7 | 168 | 0.035 | 0.016 | C |
| 29 | A9-1 | Silica 1 | 60 | 6 | Polyether-modified | 2.0 | 0.7 | 152 | 0.035 | 0.019 | C |
| 30 | A11-1 | Silica 1 | 60 | 6 | Polyether-modified | 0.5 | 0.7 | 157 | 0.034 | 0.018 | C |
| 31 | A11-1 | Silica 1 | 60 | 6 | Polyether-modified | 2.0 | 0.7 | 163 | 0.031 | 0.018 | C |
| 32 | A1-1 | Silica 1 | 60 | 6 | Polyether-modified | 1.0 | 4 | 135 | 0.034 | 0.021 | B |
| 33 | A1-2 | Silica 1 | 60 | 3 | Polyether-modified | 0.5 | 4 | 146 | 0.039 | 0.025 | B |
| 34 | A1-2 | Silica 1 | 60 | 10 | Polyether-modified | 0.5 | 4 | 148 | 0.031 | 0.023 | B |
| 35 | A1-1 | Silica 3 | 300 | 10 | Polyether-modified | 1.0 | 4 | 138 | 0.038 | 0.018 | B |
| 36 | A1-1 | Silica 4 | 1000 | 10 | Polyether-modified | 1.0 | 4 | 144 | 0.039 | 0.023 | B |
| 37 | A1-1 | Titanium oxide 2 | 250 | 10 | Polyether-modified | 1.0 | 4 | 176 | 0.033 | 0.02 | C |
| 38 | A1-1 | PMMA | 1000 | 10 | Polyether-modified | 1.0 | 4 | 169 | 0.031 | 0.019 | C |
| 39 | A1-1 | Tospearl | 2000 | 10 | Polyether-modified | 1.0 | 4 | 177 | 0.032 | 0.018 | C |
| 40 | A2-1 | Silica 1 | 60 | 6 | Polyether-modified | 1.0 | 4 | 141 | 0.030 | 0.025 | B |
| 41 | A2-2 | Silica 1 | 60 | 3 | Polyether-modified | 1.0 | 146. | 0.036 | 0.018 | 0.016 | B |

TABLE 2-continued

| Conditions for preparation and evaluation results of photosensitive member | | | | | | | | | | | |
|---|---|---|---|---|---|---|---|---|---|---|---|
| | | | | | Silicone oil | | Under-coat layer thickness (μm) | Evaluation results | | | |
| | Type of electron transport material | Particles | | | | Content relative to particles (mass %) | | Sensitivity | Ghost | | |
| Example No. | | Type | Particle size (nm) | Content in layer (mass %) | Type | | | Light-area potential (−V) | Initial | Variation | Image level |
| 42 | A2-1 | Silica 4 | 1000 | 10 | Polyether-modified | 1.0 | 4 | 132 | 0.035 | 0.019 | B |
| 43 | A2-1 | Titanium oxide 2 | 250 | 10 | Polyether-modified | 1.0 | 4 | 171 | 0.033 | 0.019 | C |
| 44 | A2-1 | PMMA | 1000 | 10 | Polyether-modified | 1.0 | 4 | 175 | 0.038 | 0.023 | C |
| 45 | A2-1 | Tospearl | 2000 | 10 | Polyether-modified | 1.0 | 4 | 173 | 0.031 | 0.025 | C |
| 46 | A1-1 | Silica 1 | 60 | 6 | Polyether-modified | 1.0 | 4 | 141 | 0.035 | 0.017 | B |
| 47 | A1-1 | Silica 3 | 300 | 10 | Polyether-modified | 1.0 | 4 | 136 | 0.033 | 0.023 | B |
| 48 | A1-1 | Silica 4 | 1000 | 10 | Polyether-modified | 1.0 | 4 | 131 | 0.038 | 0.021 | B |
| 49 | A1-1 | Titanium oxide 2 | 250 | 10 | Polyether-modified | 1.0 | 4 | 173 | 0.038 | 0.025 | C |
| 50 | A1-1 | Tospearl | 2000 | 10 | Polyether-modified | 1.0 | 4 | 177 | 0.033 | 0.021 | C |
| 51 | A2-1 | Silica 1 | 60 | 6 | Polyether-modified | 1.0 | 4 | 132 | 0.036 | 0.017 | B |
| 52 | A2-1 | Silica 4 | 1000 | 10 | Polyether-modified | 1.0 | 4 | 141 | 0.031 | 0.017 | B |
| 53 | A2-1 | Tospearl | 2000 | 10 | Polyether-modified | 1.0 | 4 | 176 | 0.030 | 0.023 | C |

TABLE 3

| Conditions for preparation and evaluation results of photosensitive member | | | | | | | | | |
|---|---|---|---|---|---|---|---|---|---|
| | | | | | | Evaluation results | | | |
| | Solvent | | | | | Sensitivity | | | |
| Example No. | Type | Parts by mass | Drying temperature (° C.) | Content of compound A (ppm) | Content of compound B (ppm) | Light-area potential (−V) | Ghost Initial | Ghost Variation | Image level |
| 54 | Acetone/ 1-Butanol | 40/60 | 170 | 0.38 | 1.38 | 121 | 0.02 | 0.006 | A |
| 55 | Acetone/ 1-Butanol | 50/50 | 170 | 0.98 | 0.89 | 125 | 0.029 | 0.003 | A |
| 56 | Acetone/ 1-Butanol | 30/70 | 150 | 0.46 | 2.17 | 131 | 0.034 | 0.012 | B |
| 57 | Acetone/ 1-Butanol | 70/30 | 150 | 1.88 | 2.38 | 136 | 0.034 | 0.009 | B |
| 58 | Acetone/ 1-Butanol | 50/50 | 190 | 0.11 | 0.26 | 142 | 0.04 | 0.009 | B |
| 59 | Acetone/ 1-Butanol | 20/80 | 140 | 2.78 | 4.58 | 156 | 0.031 | 0.016 | C |
| 60 | Acetone/ 1-Butanol | 80/20 | 140 | 3.14 | 3.79 | 166 | 0.039 | 0.018 | C |
| 61 | MEK/ 1-Butanol | 50/50 | 170 | 0.19 | 1.18 | 135 | 0.037 | 0.005 | B |
| 69 | Acetone/ 1-Propanol | 50/50 | 170 | 0.24 | 1.83 | 141 | 0.036 | 0.002 | B |
| 63 | Methanol/ 1-Butanol | 50/50 | 170 | None | 2.11 | 156 | 0.034 | 0.021 | C |
| 64 | Methanol/ 2-Propanol | 50/50 | 170 | None | 1.71 | 167 | 0.03 | 0.02 | C |
| 65 | THF/ 1-Methoxy-2-propanol | 50/50 | 170 | None | 0.92 | 161 | 0.035 | 0.017 | C |
| 66 | THF/ Cyclohexanone | 50/50 | 170 | None | None | 159 | 0.03 | 0.024 | C |

TABLE 4

Conditions for preparation and evaluation results of photosensitive member

| Com. Ex. No. | Type of electron transport material | Particles Type | Particles Particle size (nm) | Particles Content in layer (mass %) | Silicone oil Type | Silicone oil Content relative to particles (mass %) | Undercoat layer thickness (μm) | Evaluation results Sensitivity Light-area potential (−V) | Evaluation results Ghost Initial | Evaluation results Ghost Variation | Evaluation results Ghost Image level |
|---|---|---|---|---|---|---|---|---|---|---|---|
| 1 | (7) | Silica 5 | 15 | 3 | None | 0 | 0.7 | 165 | 0.038 | 0.042 | E |
| 2 | (7) | Silica 5 | 15 | 4 | None | 0 | 4 | 185 | 0.036 | 0.034 | E |
| 3 | (7) | Silica 5 | 15 | 4 | None | 0 | 4 | 170 | 0.0331 | 0.042 | E |
| 4 | (7) | Tospearl | 2000 | 16 | None | 0 | 4 | 188 | 0.037 | 0.041 | E |
| 5 | (7) | Tospearl | 2000 | 16 | None | 0 | 4 | 173 | 0.0351 | 0.038 | E |
| 6 | (7) | Silica 5 | 15 | 3 | None | 0 | 2 | 179 | 0.046 | 0.051 | E |
| 7 | A1-7 | Silica 5 | 15 | 3 | None | 0 | 2 | 166 | 0.025 | 0.031 | D |

Com Ex.: Comparative Example

In Tables 2 and 4, the electron transport materials A9-1 and A11-1 are compounds represented by formulae below.

Regarding the particles, Silica 1 represents a slurry (trade name: IPA-ST-UP, silica ratio: 15% by mass, manufactured by Nissan Chemical Corporation) in which silica particles are dispersed in isopropyl alcohol (average primary particle size: 60 nm); Silica 2 represents a slurry (trade name: IPA-ST-ZL, silica ratio: 30% by mass, manufactured by Nissan Chemical Corporation) in which silica particles are dispersed in isopropyl alcohol (average primary particle size: 90 nm); Silica 3 represents silica particles (trade name: KE-P30, manufactured by Nippon Shokubai Co., Ltd.) (average primary particle size: 300 nm); Silica 4 represents silica particles (trade name: KE-P150, manufactured by Nippon Shokubai Co., Ltd.) (average primary particle size: 1,000 nm); Silica 5 represents silica particles (trade name: RX200, manufactured by Nippon Aerosil Co., Ltd.) (average primary particle size: 15 nm); Titanium oxide 1 represents a powder of titanium oxide particles (trade name: TTO-S-4, manufactured by Ishihara Sangyo Kaisha, Ltd.) (average primary particle size: 70 nm); Titanium oxide 2 represents a powder of titanium oxide particles (trade name: JR-403, manufactured by Tayca Corporation) (average primary particle size: 250 nm); Zinc oxide represents a powder of zinc oxide particles (trade name: ZnO-650, manufactured by Sumitomo Osaka Cement Co., Ltd.) (average primary particle size: 70 nm); PMMA represents PMMA particles (trade name: TECHPOLYMER SSX-101, manufactured by Sekisui Plastics Co., Ltd.) (average primary particle size: 1,000 nm); and Tospearl represents silicone resin particles (trade name: Tospearl 120, manufactured by Momentive Performance Materials Inc.) (average primary particle size: 2,000 nm).

Furthermore, regarding the silicone oils, Polyether-modified represents a polyether-modified silicone oil (trade name: SH28PA, manufactured by Dow Corning Toray Co., Ltd.); Alkyl-modified represents an alkyl-modified silicone oil (trade name: SF8416, manufactured by Dow Corning Toray Co., Ltd.); and Carboxyl-modified represents a carboxyl-modified silicone oil (trade name: BY16-750, manufactured by Dow Corning Toray Co., Ltd.).

(A9-1)

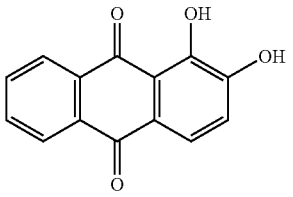

(A11-1)

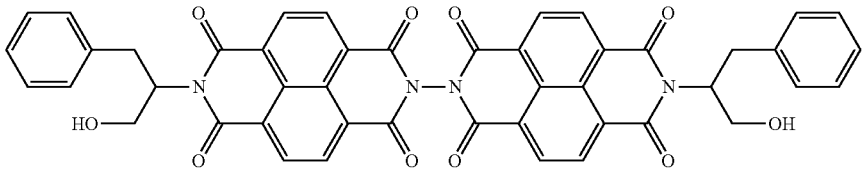

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-075769 filed Apr. 10, 2018, which is hereby incorporated by reference herein in its entirety.

What is claimed is:

1. An electrophotographic photosensitive member comprising:

an undercoat layer;

a charge generation layer; and a charge transport layer in this order, wherein the undercoat layer contains a cured product of a composition containing an electron transport material, a particle having an average primary particle size of 10 nm or more, and a silicone oil, a content of the particle in the undercoat layer is 3% by mass or more and 20% by mass or less, and a content of the silicone oil in the undercoat layer is 0.01% by mass or more and 10% by mass or less relative to the content of the particle.

2. The electrophotographic photosensitive member according to claim 1, wherein the electron transport material is at least one selected from compounds represented by formulae (A1) and (A2):

(A1)

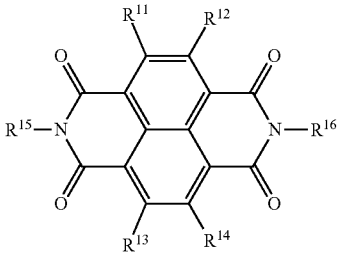

where $R^{15}$ and $R^{16}$ are each independently a substituted or unsubstituted alkyl group having 2 to 6 carbon atoms, a group obtained by substituting at least one $CH_2$ in the main chain of a substituted or unsubstituted alkyl group having 3 to 6 main-chain carbon atoms with an oxygen atom, a group obtained by substituting at least one $CH_2$ in the main chain of a substituted or unsubstituted alkyl group having 3 to 6 main-chain carbon atoms with $NR^{124}$, a group obtained by substituting at least one $C_2H_4$ in the main chain of a substituted or unsubstituted alkyl group having 3 to 6 main-chain carbon atoms with COO, or a substituted aryl group; $R^{124}$ represents a hydrogen atom or an alkyl group having 1 to 4 carbon atoms; the substituents of the substituted alkyl group, the group obtained by substituting at least one $CH_2$ in the main chain of the substituted alkyl group with an oxygen atom, the group obtained by substituting at least one $CH_2$ in the main chain of the substituted alkyl group with $NR^{24}$, and the group obtained by substituting at least one $C_2H_4$ in the main chain of the substituted alkyl group with COO are each a group selected from the group consisting of an alkyl group having 1 to 5 carbon atoms, a benzyl group, an alkoxycarbonyl group, a phenyl group, a hydroxy group, a thiol group, an amino group, and a carboxyl group; the substituent of the substituted aryl group is a group selected from the group consisting of a halogen atom, a cyano group, a nitro group, a methyl group, an ethyl group, an isopropyl group, a n-propyl group, a n-butyl group, an acyl group, an alkoxy group, an alkoxycarbonyl group, a hydroxy group, a thiol group, an amino group, and a carboxyl group; at least one of $R^{15}$ and $R^{16}$ has at least one hydroxy group or at least one carboxyl group as a substituent; and $R^{11}$ to $R^{14}$ each independently represent a hydrogen atom, a halogen atom, a cyano group, a nitro group, a substituted or unsubstituted alkyl group having 1 to 6 carbon atoms, or a substituted or unsubstituted aryl group, and (A2)

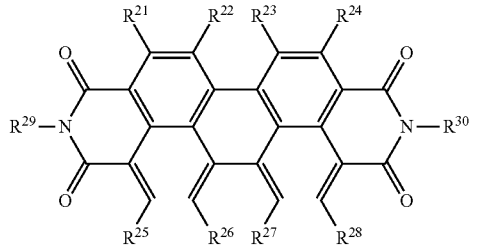

where $R^{29}$ and $R^{30}$ are each independently a substituted or unsubstituted alkyl group having 2 to 6 carbon atoms, a group obtained by substituting at least one $CH_2$ in the main chain of a substituted or unsubstituted alkyl group having 3 to 6 main-chain carbon atoms with an oxygen atom, a group obtained by substituting at least one $CH_2$ in the main chain of a substituted or unsubstituted alkyl group having 3 to 6 main-chain carbon atoms with $NR^{124}$, a group obtained by substituting at least one $C_2H_4$ in the main chain of a substituted or unsubstituted alkyl group having 3 to 6 main-chain carbon atoms with COO, or a substituted aryl group; $R^{124}$ represents a hydrogen atom or an alkyl group having 1 to 4 carbon atoms; the substituents of the substituted alkyl group, the group obtained by substituting at least one $CH_2$ in the main chain of the substituted alkyl group with an oxygen atom, the group obtained by substituting at least one $CH_2$ in the main chain of the substituted alkyl group with $NR^{124}$, and the group obtained by substituting at least one $C_2H_4$ in the main chain of the substituted alkyl group with COO are each a group selected from the group consisting of an alkyl group having 1 to 5 carbon atoms, a benzyl group, an alkoxycarbonyl group, a phenyl group, a hydroxy group, a thiol group, an amino group, and a carboxyl group; the substituent of the substituted aryl group is a group selected from the group consisting of a halogen atom, a cyano group, a nitro group, a methyl group, an ethyl group, an isopropyl group, a n-propyl group, a n-butyl group, an acyl group, an alkoxy group, an alkoxycarbonyl group, a hydroxy group, a thiol group, an amino group, and a carboxyl group; at least one of $R^{29}$ and $R^{30}$ has at least one hydroxy group or at least one carboxyl group as a substituent; and $R^{21}$ to $R^{28}$ each independently represent a hydrogen atom, a halogen atom, a cyano group, a nitro group, a substituted or unsubstituted alkyl group having 1 to 6 carbon atoms, or a substituted or unsubstituted aryl group.

3. The electrophotographic photosensitive member according to claim 1, wherein the silicone oil is a polyether-modified silicone oil, and a content of the polyether-modified silicone oil in the undercoat layer is 0.1% by mass or more and 3% by mass or less relative to the content of the particle.

4. The electrophotographic photosensitive member according to claim 1, wherein the particle is a silica particle having an average primary particle size of 10 nm or more and 500 nm or less.

5. The electrophotographic photosensitive member according to claim 1, wherein the undercoat layer further contains a compound represented by formula (A) and a compound represented by formula (B), a content of the compound represented by formula (A) in the undercoat layer is 0.1 ppm or more and 5.0 ppm or less, and a content of the compound represented by formula (B) in the undercoat layer is 0.1 ppm or more and 5.0 ppm or less:

(A)

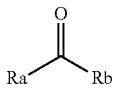

where $R_a$ and $R_b$ each independently represent a substituted or unsubstituted alkyl group having 3 or less carbon atoms, and the substituent of the substituted alkyl group is a methyl group, and (B)

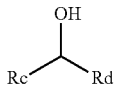

where $R_c$ and $R_d$ each independently represent a hydrogen atom or a substituted or unsubstituted alkyl group having 4 or less carbon atoms, and the substituent of the substituted alkyl group is a methyl group.

6. The electrophotographic photosensitive member according to claim 1, wherein the cured product of a composition containing an electron transport material, the cured product being contained in the undercoat layer, is a cured product of a composition containing an electron transport material, a crosslinking agent, and a resin.

7. A process cartridge detachably attachable to a main body of an electrophotographic apparatus, the process cartridge integrally supporting an electrophotographic photosensitive member and at least one device selected from the group consisting of a charging device, a developing device, a transfer device, and a cleaning device, wherein the electrophotographic photosensitive member includes an undercoat layer, a charge generation layer, and a charge transport layer in this order, the undercoat layer contains a cured product of a composition containing an electron transport material, a particle having an average primary particle size of 10 nm or more, and a silicone oil, a content of the particle in the undercoat layer is 3% by mass or more and 20% by mass or less, and a content of the silicone oil in the undercoat layer is 0.01% by mass or more and 10% by mass or less relative to the content of the particle.

8. An electrophotographic apparatus comprising:

an electrophotographic photosensitive member;

a charging device;

an exposure device;

a developing device; and a transfer device, wherein the electrophotographic photosensitive member includes an undercoat layer, a charge generation layer, and a charge transport layer in this order, the undercoat layer contains a cured product of a composition containing an electron transport material, a particle having an average primary particle size of 10 nm or more, and a silicone oil, a content of the particle in the undercoat layer is 3% by mass or more and 20% by mass or less, and a content of the silicone oil in the undercoat layer is 0.01% by mass or more and 10% by mass or less relative to the content of the particle.

9. A method for producing an electrophotographic photosensitive member that includes an undercoat layer, a charge generation layer, and a charge transport layer in this order, the method comprising:

a step of forming an undercoat layer by drying a coating film of a coating liquid for an undercoat layer by heating, the coating liquid containing an electron transport material, a particle having an average primary particle size of 10 nm or more, a silicone oil, a compound represented by formula (A), and a compound represented by formula (B), wherein a ratio of the particle to a total solid content in the coating liquid for an undercoat layer is 3% by mass or more and 20% by mass or less, a content of the silicone oil in the coating liquid for an undercoat layer is 0.01% by mass or more and 10% by mass or less relative to a content of the particle, and a content of the compound represented by formula (A) in the coating liquid for an undercoat layer is 0.3 times or more and 3.0 times or less a content of the compound represented by formula (B) in terms of mass ratio:

(A)

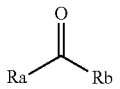

where $R_a$ and $R_b$ each independently represent a substituted or unsubstituted alkyl group having 3 or less carbon atoms, and the substituent of the substituted alkyl group is a methyl group, and (B)

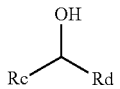

where $R_c$ and $R_d$ each independently represent a hydrogen atom or a substituted or unsubstituted alkyl group having 4 or less carbon atoms, and the substituent of the substituted alkyl group is a methyl group.

* * * * *